US010607755B2

(12) United States Patent
Honkura et al.

(10) Patent No.: US 10,607,755 B2
(45) **Date of Patent: *Mar. 31, 2020**

(54) ANISOTROPIC RARE EARTH MAGNET POWDER, METHOD FOR PRODUCING THE SAME, AND BONDED MAGNET

(71) Applicant: AICHI STEEL CORPORATION, Aichi (JP)

(72) Inventors: Yoshinobu Honkura, Aichi (JP); Chisato Mishima, Aichi (JP); Masao Yamazaki, Aichi (JP)

(73) Assignee: AICHI STEEL CORPORATION, Aichi (JP)

( * ) Notice: Subject to any disclaimer, the term of this patent is extended or adjusted under 35 U.S.C. 154(b) by 311 days.

This patent is subject to a terminal disclaimer.

(21) Appl. No.: 15/484,962

(22) Filed: Apr. 11, 2017

(65) Prior Publication Data

US 2017/0221618 A1 Aug. 3, 2017

Related U.S. Application Data

(63) Continuation of application No. 13/514,943, filed as application No. PCT/JP2010/067779 on Oct. 8, 2010, now Pat. No. 9,640,319.

(30) Foreign Application Priority Data

Dec. 9, 2009 (JP) ..... 2009-279314
Aug. 27, 2010 (JP) ..... 2010-190868

(51) Int. Cl.
*H01F 41/02* (2006.01)
*B22F 9/04* (2006.01)
(Continued)

(52) U.S. Cl.
CPC ..... *H01F 1/0578* (2013.01); *B22F 1/0007* (2013.01); *B22F 1/025* (2013.01);
(Continued)

(58) Field of Classification Search
None
See application file for complete search history.

(56) References Cited

U.S. PATENT DOCUMENTS 9,640,319 B2 * 5/2017 Honkura ..... B22F 1/025

FOREIGN PATENT DOCUMENTS

CN 101320609 A 12/2008
EP 0 286 324 A1 10/1988
(Continued)

OTHER PUBLICATIONS

Journal of the Japan Institute of Metals, vol. 72, No. 12, pp. 1010-1014 (2008), Shota Nishio et al., "Wettability Between $Nd_2Fe_{14}B$ and Nd—Fe—B Alloy System", 5 sheets, May 21, 2008.
(Continued)

*Primary Examiner* — Xiaowei Su
(74) *Attorney, Agent, or Firm* — Michael Best & Friedrich LLP

(57) ABSTRACT

Anisotropic rare earth magnet powder particles include $R_2TM_{14}B_1$-type crystals of a tetragonal compound consisting of one or more rare earth element, B, and one or more transition element, and enveloping layers containing at least Nd and Cu. Surfaces of the $R_2TM_{14}B_1$-type crystals are enveloped by the enveloping layers. The particles has an average crystal grain diameter of 0.05 to 1 μm. The particles contain, when the whole particles are taken as 100 atomic %, 11.5 to 15 atomic % of total rare earth element (Rt); 5.5 to 8 atomic % of B; and about 0.05 atomic % to about 2 atomic % of Cu. The powder particles have an atomic ratio of Cu, which is a ratio of the total number of Cu atoms to a total number of atoms of Rt, falling within the range of 1 to 6%. The powder particles do not include dysprosium Dy, Tb, Ho and Ga. Coercivity of the magnetic powder is more than 955 kA/m.

16 Claims, 8 Drawing Sheets

(51) Int. Cl.

| | |
|---|---|
| ***H01F 1/057*** | (2006.01) |
| ***B22F 9/02*** | (2006.01) |
| ***B22F 1/02*** | (2006.01) |
| ***C22C 33/02*** | (2006.01) |
| ***C22C 38/00*** | (2006.01) |
| ***C22C 38/06*** | (2006.01) |
| ***C22C 38/16*** | (2006.01) |
| ***H01F 7/02*** | (2006.01) |
| ***B22F 1/00*** | (2006.01) |
| ***C22C 38/12*** | (2006.01) |

(52) U.S. Cl.

CPC ..... *B22F 9/023* (2013.01); *B22F 9/04* (2013.01); *C22C 33/0278* (2013.01); *C22C 38/002* (2013.01); *C22C 38/005* (2013.01); *C22C 38/06* (2013.01); *C22C 38/12* (2013.01); *C22C 38/16* (2013.01); *H01F 7/02* (2013.01); *H01F 7/0221* (2013.01); *H01F 41/0293* (2013.01); *B22F 2301/355* (2013.01); *B22F 2998/10* (2013.01); *H01F 1/0572* (2013.01)

(56) References Cited

FOREIGN PATENT DOCUMENTS

| | | | |
|---|---|---|---|
| EP | 1191553 | A2 | 3/2002 |
| EP | 1 544 870 | A1 | 6/2005 |
| JP | S64-027205 | A | 1/1989 |
| JP | 01-132106 | A | 5/1989 |
| JP | H07-272914 | A | 10/1995 |
| JP | H08-316014 | A | 11/1996 |
| JP | 09-170055 | A | 6/1997 |
| JP | 10-326705 | A | 12/1998 |
| JP | 2000-096102 | A | 4/2000 |
| JP | 2000-336405 | A | 12/2000 |
| JP | 2001-076917 | A | 3/2001 |
| JP | 2002-093610 | A | 3/2002 |
| JP | 2003-301203 | A | 10/2003 |
| JP | 2005-097711 | A | 4/2005 |
| JP | 2009-054704 | A | 3/2009 |
| JP | 2010-114200 | A | 5/2010 |
| WO | WO-2006/112403 | A1 | 10/2006 |

OTHER PUBLICATIONS

International Search Report of PCT/JP2010/067779, dated Dec. 28, 2010.

Witten Opinion of International Searching Authority of PCT/JP2010/067779, dated Dec. 28, 2010.

Office Action issued in Japanese Patent Application No. 211-545136, dated Aug. 6, 2013.

Extended EP Search Report issued in European Application No. 10835769.0, dated Feb. 3, 2014.

Machine translation of CN 101320609 A, Dec. 2008.

* cited by examiner

AFTER DIFFUSION TREATMENT

BEFORE DIFFUSION TREATMENT

INGOT
(NO DIFFUSION TREATMENT)

DIFFUSION RAW MATERIAL C2: 6 % by mass

DIFFUSION RAW MATERIAL C2: 3 % by mass

WITHOUT DIFFUSION RAW MATERIAL

ANISOTROPIC RARE EARTH MAGNET POWDER, METHOD FOR PRODUCING THE SAME, AND BONDED MAGNET

RELATED APPLICATIONS

This is a continuation of U.S. patent application Ser. No. 13/514,943 filed on Aug. 28, 2012, now pending, which is a 371 of PCT/JP2010/067779 filed on Oct. 8, 2010 claiming Paris Convention priority based on Japanese Patent Application Nos. 2009-279314 filed on Dec. 9, 2009 and 2010-190868 filed on Aug. 27, 2010. The contents of these applications, including the specifications, the claims and the drawings, are incorporated herein by reference in their entirety.

TECHNICAL FIELD

The present invention relates to anisotropic rare earth magnet powder having good magnetic characteristics, a method for producing the same, and a bonded magnet.

BACKGROUND ART

A bonded magnet comprising a shaped solid body of rare earth magnet powder bonded with a binder resin exhibits very high magnetic characteristics and at the same time has a high degree of freedom in shape and the like. Therefore, such bonded magnets are expected to be used in various kinds of devices, such as electric appliances and automobiles which are desired to achieve energy saving and weight reduction.

However, in order to increase the use of the bonded magnets, the bonded magnets are needed to exhibit stable magnetic characteristics even in a high-temperature environment. Therefore, earnest research and development is carried out to improve coercivity of bonded magnets or rare earth magnet powders these days.

The present research and development is just at such a level to add or diffuse dysprosium (Dy), gallium (Ga) and the like to rare earth magnet powder to improve its coercivity. However, Dy, Ga and the like are very scarce elements and use of these elements has a lot of problems in view of stable securement of resources, cost reduction and so on. Therefore, a method for improving coercivity of rare earth magnet powder while suppressing the use of scarce elements has been looked for.

SUMMARY OF INVENTION

This invention relates to anisotropic rare earth magnet powder particles include $R_2TM_{14}B_1$-type crystals of a tetragonal compound consisting of a rare earth element (R), boron (B), and a transition element (TM), and enveloping layers containing at least Nd and Cu. Surfaces of the $R_2TM_{14}B_1$-type crystals are enveloped by the enveloping layers. The particles has an average crystal grain diameter of 0.05 to 1 μm. The particles contain, when the whole particles are taken as 100 at %, 11.5 to 15 at. % of total number of the rare earth element; 5.5 to 8 at. % of B; and 0.05 to 2 at. % of Cu. The particles have an atomic ratio of Cu, which is a ratio of the total number of Cu atoms to the Rt, falling within the range of 1 to 6%. The particles do not include Dy, Tb, Ho and Ga. Coercivity of the powder particles is more than 955 kA/m.

DESCRIPTION OF EMBODIMENTS

Figure 1:
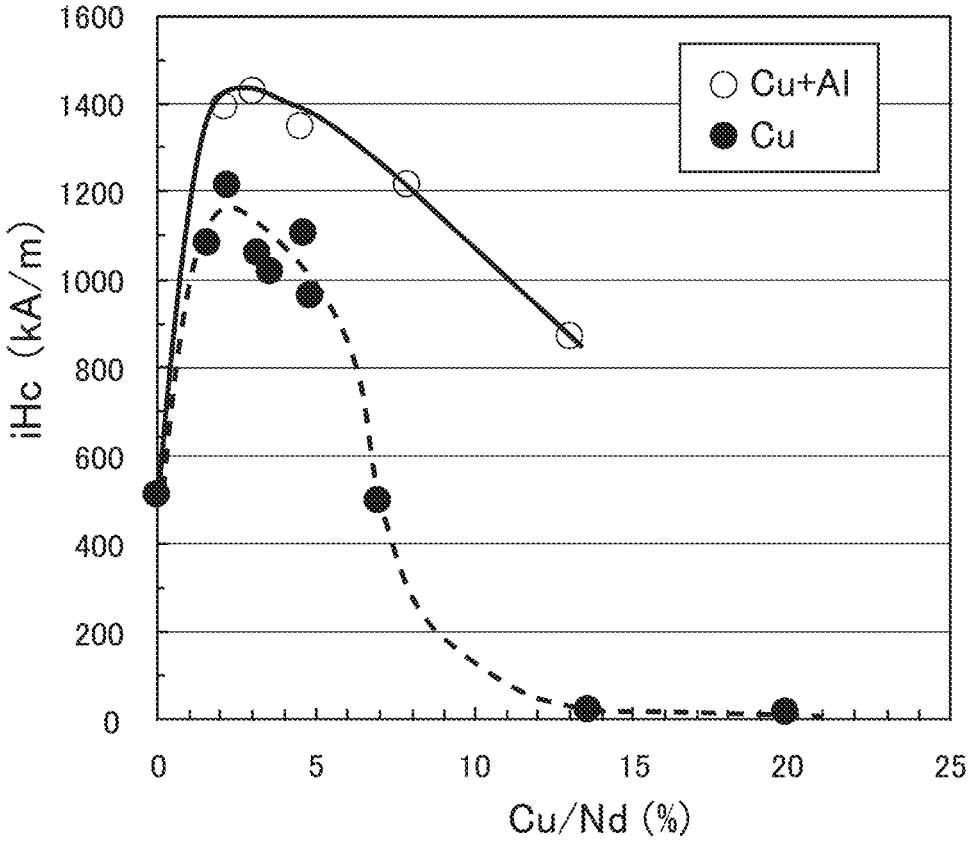
FIG. 1 is a graph showing a relation between the atomic ratio of Cu and coercivity.

The present invention will be described in more detail by way of embodiments of the present invention. What is discussed in the description of the present invention including the following embodiments can be applied not only to the anisotropic rare earth magnet powder but also the method for producing the same, the bonded magnet and the like according to the present invention. Therefore, one or more constituents arbitrarily selected from those stated in the description of the present invention can be added to the abovementioned constitution of the present invention. In this case, constitution of the production method can be regarded as constitution of a product when understood as a product by process. It should be noted that which embodiment is best is different with application targets, required performance and so on.

<Anisotropic Rare Earth Magnet Powder>

(1) Anisotropic rare earth magnet powder of the present invention includes powder particles having $R_2TM_{14}B_1$-type crystals of a tetragonal compound of a rare earth element (hereinafter referred to as "R"), boron (B), and a transition element (hereinafter referred to as "TM") having an average crystal grain diameter of 0.05 to 1 μm, and enveloping layers containing at least a rare earth element (hereinafter referred to as "R'") and copper (Cu) and enveloping surfaces of the $R_2TM_{14}B_1$-type crystals.

(2) "R" and "R'" mentioned herein are used as terms representing specific name of one or more rare earth elements. That is to say, "R" or "R'" means one or more kinds of elements of all the rare earth elements unless otherwise mentioned. Therefore, "R" and "R'" are sometimes the same kind of rare earth element (for example, Nd), and are sometimes different from each other. When R or R' means plural kinds of rare earth elements, sometimes all of R and R' are identical with each other, sometimes some of R and R' are identical with each other and others of R and R' are different from each other, and sometimes all of R and R' are different from each other.

However, in the description of the present invention, one or more rare earth elements constituting a tetragonal compound as a main phase of magnet (i.e., $R_2TM_{14}B_1$-type crystals) are uniformly expressed as "R" and one or more rare earth elements constituting enveloping layers are uniformly expressed as "R'" for the purpose of convenience. That is to say, R and R' are expressions for the purpose of convenience based on the form of powder particles as "objects" (whether they are "tetragonal portions" or "enveloping layer portions") and are not expressions based on their production processes or supply sources (raw materials) and the like of powder particles. For example, even if it is the same rare earth element in a magnet raw material (a base alloy), what contributes to formation of a tetragonal compound (i.e., $R_2TM_{14}B_1$-type crystals) is expressed by "R" and what is an excessive amount of the rare earth element discharged in forming the tetragonal compound and forms enveloping layers is expressed by "R'".

It should be noted that when a rare earth element (or all kinds of rare earth elements) contained in the whole powder particles is needed to be generally expressed by a symbol without any distinction between the tetragonal compound and the enveloping layers, "Rt" is appropriately used. When a rare earth element (or all kinds of rare earth elements) contained in a magnet raw material is needed to be expressed by a symbol, "Rm" is appropriately used. It should be noted that when it is simply called "a (the) rare earth element", it means "a (the) rare earth element" as a general idea which is one or more elements of all the rare earth elements and includes R, R', Rt, Rm and the like.

(3) According to the present invention, owing to the presence of the aforementioned enveloping layers, it is possible to obtain anisotropic rare earth magnet powder which exhibits a high magnetic flux density and a very high coercivity. Besides, the enveloping layers can be constituted by easily available and relatively inexpensive R' and Cu. That is to say, in the present invention, a scarce and expensive element such as Dy is not always needed to improve coercivity. Therefore, according to the present invention, stable supply and cost reduction of anisotropic rare earth magnet powder can be achieved.

Although mechanism in which the anisotropic rare earth magnet powder of the present invention exhibits good magnetic characteristics is not all clear, it is assumed at present as follows. As is often the case, a R'—Cu material (an alloy, a compound, etc.) constituting the enveloping layers of the present invention is non-magnetic and has a low melting point. The enveloping layers comprising such a material are easy to wet and cover surfaces of $R_2TM_{14}B_1$-type crystals as a main phase of magnet. Therefore, the enveloping layers are thought to correct distortion present on the surfaces of the $R_2TM_{14}B_1$-type crystals and suppress generation of reverse magnetic domains in the vicinity of the surfaces. Moreover, the enveloping layers are thought to isolate the respective $R_2TM_{14}B_1$-type crystals and interrupt the magnetic interaction between adjacent $R_2TM_{14}B_1$-type crystals. This is thought to be the reason why the anisotropic rare earth magnet powder of the present invention can attain a remarkable improvement in coercivity while suppressing a decrease in magnetic flux density.

It should be noted that the $R_2TM_{14}B_1$-type crystals of the present invention are very fine and surface layers and grain boundaries of the crystals are much finer. Therefore, it is not always easy to directly observe the enveloping layers of the present invention. Although the enveloping layers are not observed directly, if very good magnetic characteristics (especially coercivity) exhibited by the anisotropic rare earth magnet powder of the present invention are comprehensively considered in view of a number of research results on anisotropic rare earth magnet powders, it can be said that the powder particles of the present invention have the abovementioned $R_2TM_{14}B_1$-type crystals and the enveloping layers. For example, as apparent from the description of examples mentioned later, when specimens of the present invention are compared with specimens in which Cu is contained in mere ingots (base magnet alloys) as in conventional ones, even they have almost the same composition as whole powder (particles), the former are remarkably better in magnetic characteristics (especially coercivity) than the latter. When these circumstances are taken into consideration, it is apparent that the powder particles of the present invention are constituted by the abovementioned $R_2TM_{14}B_1$-type crystals and the enveloping layers, though not directly observed.

(4) In the present invention, the form, particle diameter or the like of the powder particles is not limited. The form or thickness of the enveloping layers is not limited, either. The powder particles of the present invention only have to include $R_2TM_{14}B_1$-type crystals having surfaces enveloped by the enveloping layers in at least part of themselves. Therefore, it is not always necessary that surfaces of the powder particles in themselves comprising aggregates of a number of crystals are enveloped by the enveloping layers.

Furthermore, anisotropic rare earth magnet powder comprising a collective entity of powder particles only has to include the powder particles of the present invention in at least part of themselves. That is to say, all the powder particles constituting the anisotropic rare earth magnet powder of the present invention do not have to be powder particles comprising the $R_2TM_{14}B_1$-type crystals and the enveloping layers. Therefore, the anisotropic rare earth magnet powder of the present invention can be a mixed powder of plural kinds of powder particles.

The average crystal grain diameter mentioned in the present invention is determined by the method for measuring an average particle diameter of crystal grains in JIS G 0551. The existence ratio of the $R_2TM_{14}B_1$-type crystals as a main phase and the enveloping layers which lie on outer peripheries (surfaces) of the crystals in the powder particles of the present invention is not limited. However, a smaller volume ratio of the enveloping layers in the powder particles of the present invention is more preferred.

R or R' mentioned in the present invention is at least one of yttrium (Y), lanthanoid, and actinoid. Typical examples of R or R' include lanthanum (La), cerium (Ce), praseodymium (Pr), neodymium (Nd), samarium (Sm), gadolinium (Gd), terbium (Tb), dysprosium (Dy), holmium (Ho), erbium (Er), thulium (Tm), and lutetium (Lu). More specifically, Nd is generally used. R and R' can be totally identical, partially identical, or totally different.

It is especially preferable that TM is at least one element of 3d transition elements and 4d transition elements. 3d transition elements are elements with atomic numbers 21 (Sc) through 29 (Cu), and 4d transition elements are elements with atomic numbers 39 (Y) through 47 (Ag). It is especially preferable that TM is any one of iron (Fe) in group 8, cobalt (Co) and nickel (Ni), and it is more preferable that TM is Fe. It is also possible to replace part of boron with carbon (C).

<Method for Producing Anisotropic Rare Earth Magnet Powder>

The production method of the anisotropic rare earth magnet powder of the present invention is not limited, but production by the following production method of the present invention is suitable, because anisotropic rare earth magnet powder having high magnetic characteristics is obtained efficiently. That is to say, the anisotropic rare earth magnet powder of the present invention can be obtained by a production method comprising a mixing step of obtaining a mixed raw material of a magnet raw material capable of generating $R_2TM_{14}B_1$-type crystals of a tetragonal compound of R, B and TM, and a diffusion raw material to serve as a supply source of at least R' and Cu; and a diffusion step of heating the mixed raw material to diffuse at least a rare earth element to become R' and Cu onto surfaces or into crystal grain boundaries of the $R_2TM_{14}B_1$-type crystals.

It should be noted that "a diffusion raw material to serve as a supply source of at least R' and Cu" indicates that the diffusion raw material can be a raw material containing necessary elements to form the enveloping layers together or a mixture of raw materials which contain those necessary elements individually and independently.

<Bonded Magnet or Compound>

Furthermore, the present invention can be grasped as a bonded magnet using the abovementioned anisotropic rare earth magnet powder. That is to say, the present invention can be a bonded magnet comprising the aforementioned anisotropic rare earth magnet powder, and a resin bonding the powder particles of the anisotropic rare earth magnet powder together. Besides, the present invention can be a compound used for production of this bonded magnet. The compound is a material in which a binder resin is attached beforehand to surfaces of respective powder particles. The anisotropic rare earth magnet powder used for the bonded magnet or the compound can be a composite powder in which plural kinds of magnet powders having different average particle diameters and compositions are mixed.

<Others>

(1) The anisotropic rare earth magnet powder of the present invention can contain one or more "reforming elements" which are effective in improving characteristics, in addition to the aforementioned rare earth element (including R and R'), B, TM and Cu. There are various kinds of reforming elements and the respective elements can be arbitrarily combined and the content of these elements is generally very small. As a matter of course, the anisotropic rare earth magnet powder of the present invention can contain "inevitable impurities", which are difficult to be removed for cost, technical or other reasons.

(2) A range "x to y" mentioned in the description of the present invention includes a lower limit value x and an upper limit value y, unless otherwise specified. Moreover, the various lower limit values and upper limit values in the description of the present invention can be arbitrarily combined to constitute a range "a to b". Furthermore, any given numerical value within the ranges in the description of the present invention can be used as an upper limit value or a lower limit value for setting a numerical value range.

<Powder Particles>

(1) The powder particles of the present invention comprise agglomerates of $R_2TM_{14}B_1$-type crystals. The composition of this tetragonal compound in terms of atomic % (at. %) comprises 11.8 at. % of R, 5.9 at. % of B and the remainder being TM.

However, since the powder particles of the present invention have the enveloping layers containing R' in addition to the $R_2TM_{14}B_1$-type crystals, when considered with respect to the whole powder particles, preferably the content of the rare earth element (Rt: the entire rare earth element(s) in powder particles including R and R') is 11.5 to 15 at. %. When this content is greater than the aforementioned theoretical composition value of the tetragonal compound, a rare earth element-rich phase such as an Nd-rich phase is easily formed and coercivity of anisotropic rare earth magnet powder can be improved. In consideration of these, it is more preferable that Rt is 12 to 15 at. % and B is 5.5 to 8 at. % when the whole powder particles are taken as 100 at. %.

The powder particles can contain various kinds of elements which are effective in improving characteristics in addition to the abovementioned elements. Examples of these reforming elements include titanium (Ti), vanadium (V), zirconium (Zr), niobium (Nb), nickel (Ni), chromium (Cr), manganese (Mn), molybdenum (Mo), hafnium (Hf), tungsten (W), tantalum (Ta), which are TMs, and also include aluminum (Al), gallium (Ga), silicon (Si), zinc (Zn) and tin (Sn) The powder particles can contain one or more of these elements.

However, if the content of these elements is excessively large, magnetic characteristics of magnet powder may decrease. Therefore, it is preferable that the total content of reforming elements is not more than 3 at. % when the whole powder particles are taken as 100 at. %.

Especially, Ga is an effective element in improving coercivity of anisotropic rare earth magnet powder. Preferably the powder particles contain 0.05 to 1 at. % of Ga when the whole powder particles are taken as 100 at. %. Besides, Nb is an effective element in improving residual magnetic flux density. Preferably the powder particles contain 0.05 to 0.5 at. % of Nb when the whole powder particles are taken as 100 at. %. Of course, combined addition of both the elements is more preferred. Co is an effective element in increasing the Curie point of magnet powder and consequently improving its heat resistance. Preferably the magnet powder contains 0.1 to 10 at. % of Co when the whole powder particles are taken as 100 at. %.

(2) When the amount of the enveloping layers in the powder particles according to the present invention is excessively small, coercivity of anisotropic rare earth magnet powder is not improved. When this amount is excessively large, the amount of $R_2TM_{14}B_1$-type crystals relatively decreases, which causes a decrease in magnetic characteristics such as magnetic flux density.

With respect to the enveloping layers, it is preferable that the Cu content is 0.05 to 2 at. % or 0.2 to 1 at. % of C when the whole powder particles are taken as 100 at. %. Moreover, if the enveloping layers of the present invention contain Al in addition to R' and Cu, anisotropic rare earth magnet powder having a higher coercivity can be obtained. When the Al content is excessively small, the effect is small. When the Al content is excessively large, magnetic flux density of magnet powder decreases. Preferably the Al content is 0.1 to 5 at. % or 1 to 3 at. % when the whole powder particles are taken as 100 at. %.

By the way, as a result of earnest studies, the present inventors have found that there is a preferred ratio of the rare earth element (especially Nd) to Cu contained in the whole powder particles in order to improve coercivity of anisotropic rare earth magnet powder. In other words, there is a correlation between the atomic ratio of Cu, which is a ratio of the total number of Cu atoms to the total number of rare earth element (Rt) atoms (Cu/Rt) and coercivity of anisotropic rare earth magnet powder.

However, preferred atomic ratio of Cu can somewhat vary with composition of the enveloping layers. For example, when the enveloping layers comprise R' and Cu, the atomic ratio of Cu is preferably 0.2 to 6.8% or 0.6 to 6.2%. When the enveloping layers further contain Al, preferably the atomic ratio of Cu is 0.6 to 11.8% or 1 to 8.6%. In both the cases, it is suitable that the atomic ratio of Cu falls within the range of 1 to 6%, 1.3 to 5% or 1.6 to 4%, because coercivity of anisotropic rare earth magnet powder can be improved.

<Production Method>

Anisotropic rare earth magnet powder can be produced by various kinds of methods, but the production method of the present invention comprises a mixing step and a diffusion step.

(1) Mixing Step

The mixing step of the present invention is a step of obtaining a mixed raw material of a magnet raw material capable of generating $R_2TM_{14}B_1$-type crystals of a tetragonal compound of R, B and TM, and a diffusion raw material to serve as a supply source of at least R' and Cu. Mixing can be carried out by using a Henschel mixer, a rocking mixer, a ball mill or the like. It is preferable that the magnet raw material and the diffusion raw material are pulverized and classified powders, because uniform mixing is easy. Preferably mixing is carried out in an oxidation-preventing atmosphere (for example, an inert gas atmosphere or a vacuum atmosphere).

Employable as the magnet raw material are, for example, ingot materials produced by casting molten metal prepared by various kinds of melting methods (high frequency melting, arc melting, etc.), strip cast materials produced by strip casting such molten metal. It is especially preferable to use strip cast materials. The reason is as follows.

In order to obtain a very high residual magnetic flux density Br, it is preferable that the content of rare earth element and the B content in the magnet raw material are close to stoichiometric composition of $R_2TM_{14}B_1$ compound. In this case, however, a large amount of αFe as a primary phase tends to remain present.

Here, in the case of ingot materials, due to a low cooling rate, the soft magnetic αFe phase tends to remain present. In order to remove this αFe phase, there is a need to increase soaking time.

This is inefficient, and magnetic characteristics of anisotropic rare earth magnet powder tend to degrade. On the other hand, in the case of strip cast materials, owing to a high cooling rate, the amount of residual soft magnetic αFe phase is small, so the residual αFe phase is finely distributed or hardly present. Therefore, the soft magnetic αFe phase can be removed in a short soaking time.

If such a strip cast material is subjected to homogenization treatment, its crystal grains grow to a preferred average crystal grain diameter of about 100 μm (50 to 250 μm). If the thus obtained strip is pulverized, it is possible to obtain a raw material of anisotropic rare earth magnet powder (i.e., a magnet raw material) in which there is no αFe phase, a rare earth element-rich phase is formed in grain boundaries and crystal grains have appropriate size.

Under these circumstances, it is preferable that the magnet raw material contains at least 11.5 to 15 at. % of the rare earth element when the entire magnet raw material is taken as 100 at. %. If a strip cast material is thus used, a lower limit value of the content of the rare earth element in the magnet raw material can be lower than a theoretical composition value of the tetragonal compound. Of course it is preferable that the magnet raw material to be mixed with the diffusion raw material has a powdery shape obtained by applying hydrogen decrepitation and mechanical pulverization to an ingot or a strip.

The diffusion raw material is single substances, one or more alloys, or one or more chemical compounds to serve as a supply source of R' and Cu. The diffusion raw material can be a mixture of plural kinds of raw materials in accordance with desired composition. It should be noted that at least one of the magnet raw material and the diffusion raw material can be a hydride. A hydride is a substance in which hydrogen is bonded to or solid solved in a single substance, an alloy, a chemical compound or the like. The amount of the diffusion raw material is preferably 0.1 to 10% by mass or 1 to 6% by mass when the entire mixed raw material is taken as 100% by mass. An excessively small amount of diffusion raw material results in insufficient formation of the enveloping layers. On the other hand, an excessively large amount of diffusion raw material decreases magnetic flux density of anisotropic rare earth magnet powder.

(2) Diffusion Step

The diffusion step of the present invention is a step of heating the abovementioned mixed raw material to diffuse at least a rare earth element to become R' and Cu onto surfaces or into crystal grain boundaries of the $R_2TM_{14}B_1$-type crystals. Although diffusion of the rare earth element or Cu is classified into surface diffusion, grain boundary diffusion, and volume diffusion, the enveloping layers are thought to be mainly formed by surface diffusion or grain boundary diffusion. Preferably heating in the diffusion step is carried out at a temperature at which the diffusion raw material easily melts and diffuses into grain boundaries. For example, the diffusion step can be carried out in an oxidation-preventing atmosphere (a vacuum atmosphere, an inert atmosphere or the like) at 400 to 900 deg. C., though depending on the total composition of the diffusion raw material. At an excessively low heating temperature, diffusion does not proceed, and on the other hand, at an excessively high heating temperature, $R_2TM_{14}B_1$-type crystals become coarse.

When a hydride is used as the magnet raw material or the diffusion raw material, it is preferable that the diffusion step and a dehydrogenation step are integrally performed and then the resultant raw material is rapidly cooled. Specifically speaking, it is preferable that a mixed raw material of a hydride of a magnet raw material or a hydride of a diffusion raw material is placed in a vacuum atmosphere under not more than 1 Pa at 700 to 900 deg. C. When hydrogen remains present in the mixed raw material, it is possible to perform a dehydrogenation (exhaust) step after the diffusion step or perform the diffusion step after a dehydrogenation step. When anisotropic rare earth magnet powder is produced through such a diffusion step, the enveloping layers of the present invention are a diffusion layer in which at least R' and Cu are diffused onto surfaces or into crystal grain boundaries of $R_2TM_{14}B_1$-type crystals.

(3) Hydrogen Treatment of Magnet Raw Material

Powder particles comprising agglomerates of fine $R_2TM_{14}B_1$-type crystals having an average crystal grain diameter of 0.05 to 1 μm can be obtained by applying a well-known hydrogen treatment to the magnet raw material as a base material. This hydrogen treatment comprises a disproportionation step of causing a base alloy to absorb hydrogen and undergo a disproportionation reaction, and a recombination step of dehydrating and recombining the base alloy after this disproportionation step, and is called HDDR (hydrogenation-decomposition (or disproportionation)—desorption-recombination) or d-HDDR (dynamic-hydrogenation-decomposition (or disproportionation)—desorption-recombination).

For example, in the case of d-HDDR, the disproportionation step comprises at least a high-temperature hydrogenation step, and the recombination step comprises at least a dehydrogenation step (more specifically, a controlled exhaust step). Hereinafter, the respective steps of the hydrogen treatment will be described.

(a) A low-temperature hydrogenation step is a step of incorporating a sufficient amount of hydrogen in solid solution by applying hydrogen pressure in a low temperature range below temperatures at which a hydrogenation reaction or a disproportionation reaction occurs, so that hydrogenation and disproportionation reactions in the following step (a high-temperature hydrogenation step) gently proceed. More specifically speaking, the low-temperature hydrogenation step is a step of holding a base alloy of a magnet raw material (hereinafter simply referred to as a "magnet alloy") in a hydrogen gas atmosphere at not more than 600 deg. C., thereby allowing the magnet alloy to absorb hydrogen. Upon performing this step beforehand, reaction rate of forward structural transformation in the subsequent high-temperature hydrogenation step can be controlled easily.

An excessively high temperature of the hydrogen gas atmosphere causes the magnet alloy to undergo partial structure transformation and have a non-uniform structure. Hydrogen pressure in the low-temperature hydrogenation step is not particularly limited, but a hydrogen pressure of about 0.03 to 0.1 MPa shortens treating time and makes the treatment efficient. It should be noted that the hydrogen gas atmosphere can be a mixed gas atmosphere of hydrogen gas and an inert gas. Hydrogen pressure in this case is hydrogen gas partial pressure. The same applies to the high-temperature hydrogenation step and the controlled exhaust step.

(b) The high-temperature hydrogenation step is a step of causing the magnet alloy to undergo hydrogenation and disproportionation reactions. Specifically speaking, the high-temperature hydrogenation step is a step of holding the magnet alloy after the low-temperature hydrogenation step in a hydrogen gas atmosphere under 0.01 to 0.06 MPa at 750 to 860 deg. C. This high-temperature hydrogenation step causes the magnet alloy after the low-temperature hydrogenation step to have a structure decomposed into three phases ($\alpha$Fe phase, $RH_2$ phase, $Fe_2B$ phase). In this case, since the magnet alloy already absorbs hydrogen in the low-temperature hydrogenation step, the structure transformation reaction can gently proceed under suppressed hydrogen pressure.

When hydrogen pressure is excessively small, the reaction rate is small, so untransformed structure remains present and coercivity decreases. When hydrogen pressure is excessively high, the reaction rate is high, so the anisotropy ratio decreases. When the temperature of the hydrogen gas atmosphere is excessively low, the structure decomposed into three phases tends to be non-uniform and coercivity decreases. When that temperature is excessively high, crystal grains become coarse and coercivity decreases. It should be noted that hydrogen pressure or temperature in the high-temperature hydrogenation step does not have to be constant all the time. For example, reaction rate can be controlled by increasing at least one of hydrogen pressure and temperature at a last part of the step, at which the reaction rate decreases, so as to promote three-phase decomposition (a structure stabilization step).

(c) The controlled exhaust step is a step of causing the structure decomposed into three phases in the high-temperature hydrogenation step to undergo a recombination reaction. In this controlled exhaust step, dehydration is gently carried out and a recombination reaction gently proceeds under a relatively high hydrogen pressure. More specifically speaking, the controlled exhaust step is a step of holding the magnet alloy after the high-temperature hydrogenation step in a hydrogen gas atmosphere under a hydrogen pressure of 0.7 to 6 kPa at 750 to 850 deg. C. Owing to this controlled exhaust step, hydrogen is removed from the $RH_2$ phase of the aforementioned three decomposed phases. Thus the structure recombines and a hydride of fine $R_2TM_{14}B_1$-type crystals ($RFeBH_X$) onto which crystal orientation of the $Fe_2B$ phase is transcribed is obtained. When hydrogen pressure is excessively small, removal of hydrogen is drastic and magnetic flux density decreases. When hydrogen pressure is excessively high, the abovementioned reverse transformation is insufficient and coercivity may decrease. When the treatment temperature is excessively low, reverse transformation reaction does not appropriately proceed. When the treatment temperature is excessively high, crystal grains become coarse. It should be noted that if the high-temperature hydrogenation step and the controlled exhaust step are carried at almost the same temperature, a shift from the high-temperature hydrogenation step to the controlled exhaust step can be easily achieved only by changing hydrogen pressure.

(d) The forced exhaust step is a step of removing residual hydrogen in the magnet alloy to complete dehydrogenation treatment. Treatment temperature, degree of vacuum and so on of this step are not particularly limited, but this step is preferably carried out in a vacuum atmosphere under not more than 1 Pa at 750 to 850 deg. C. When treatment temperature is excessively low, a lot of time is required for exhaust. When the treatment temperature is excessively high, crystal grains become coarse. When the degree of vacuum is excessively small, hydrogen may remain present and magnetic characteristics of the anisotropic rare earth magnet powder may decrease. It is preferable to rapidly cool the magnet powder after this step, because growth of crystal grains is suppressed.

The forced exhaust step does not have to be conducted continuously after the controlled exhaust step. A cooling step of cooling the magnet alloy after the controlled exhaust step can be conducted before the forced exhaust step. If the cooling step is provided, the forced exhaust step to be performed on the magnet alloy after the controlled exhaust step can be carried out by batch processing. The magnet alloy (the magnet raw material) in the cooling step is a hydride and has oxidation resistance. Therefore, it is possible to temporarily take out the magnet raw material into the air.

(e) By the way, when the magnet raw material is obtained through the abovementioned hydrogen treatment, the mixing step of mixing the magnet raw material and the diffusion raw material does not have to be conducted after the abovementioned forced exhaust step. That is to say, the mixing step can be performed at any time such as before the low-temperature hydrogenation step, before the high-temperature hydrogenation step, before the controlled exhaust step, and before the forced exhaust step. Moreover, the diffusion step can be carried out independently of the respective steps of the hydrogen treatment or at least one of those steps can also serve as the diffusion step. For example, when the mixing step is performed before or after the low-temperature hydrogenation step, the high-temperature hydrogenation step can also serve as the diffusion step.

However, it is preferable to mix the magnet raw material in which fine $R_2TM_{14}B_1$-type crystals ($R_2TM_{14}B_1H_x$) are generated with the diffusion raw material after the controlled exhaust step. For example, it is preferable to mix the magnet raw material after the controlled exhaust step and the diffusion raw material (the mixing step) and then perform the diffusion step which also serves as the forced exhaust step. This allows an efficient production of anisotropic rare earth magnet powder having high coercivity in which the respective $R_2TM_{14}B_1$-type crystals are appropriately enveloped by the enveloping layers.

It should be noted that the mixing step and the diffusion step can be performed after the magnet raw material after the controlled exhaust step is cooled once, or the mixing step and the diffusion step can be performed subsequently to the controlled exhaust step. Of course, it is sufficient to mix the magnet raw material after the forced exhaust step and a hydrogen-free diffusion raw material and then apply diffusion treatment of heating the mixture in an inert atmosphere without vacuum evacuation. In this case, the forced exhaust step after the diffusion step is not required.

It is preferable that the magnet raw material has an average particle diameter of 3 to 200 μm, and that the diffusion raw material has an average particle diameter of 3 to 30 μm. When the average particle diameter is excessively small, the raw material costs more and is difficult to deal with, and oxidation resistance of the magnetic characteristics tends to decrease. On the other hand, when the average particle diameter is excessively large, it is difficult to uniformly mix both the raw materials.

Moreover, powder particles comprising agglomerates of fine $R_2TM_{14}B_1$-type crystals having an average crystal grain diameter of 0.05 to 1 μm can be obtained by other methods than the abovementioned hydrogen treatment. Examples of such methods include a method of applying hot pressing or the like to isotropic rare earth magnet powder comprising agglomerates of fine $R_2TM_{14}B_1$-type crystals of about 0.03 μm produced by liquid quenching, thereby obtaining anisotropic crystals. Powder particles obtained by this method have a crystal grain diameter of about 0.3 μm.

INDUSTRIAL APPLICABILITY

Application purposes of the anisotropic rare earth magnet powder of the present invention are not limited. However, a bonded magnet comprising this anisotropic rare earth magnet powder can be used in various kinds of devices. This enables the various kinds of devices to achieve energy saving, weight and size reduction, performance enhancement and so on. A binder resin in a bonded magnet can be a thermosetting resin or a thermoplastic resin. Moreover, the binder resin can be those added by a coupling agent or a lubricant agent and kneaded.

EXAMPLES

The present invention will be described more specifically by way of examples.

Example 1

<Production of Specimens>

(1) Preparation of Magnet Raw Materials

Various kinds of magnet raw materials comprising magnet alloys having the composition shown in Table 1 were prepared (hereinafter, component composition will be all expressed in at. %. Nd in Table 1 corresponds to Rm.). These magnet raw materials were produced as follows. First, raw materials weighed so as to have the composition shown in Table 1 were melted and magnet alloys (base alloys) casted by strip casting process (hereinafter referred to as "SC process") were obtained. These magnet alloys were held in an Ar gas atmosphere at 1140 deg. C. for ten hours, thereby homogenizing structure (a homogenization heat treatment step).

Next, the magnet alloys after subjected to hydrogen decrepitation in a hydrogen atmosphere under a hydrogen pressure of 0.13 MPa were subjected to hydrogenation treatment (d-HDDR), thereby obtaining powdery magnet raw materials. This hydrogenation treatment was conducted as follows. It should be noted that the magnet alloys after this hydrogenation treatment were subjected to hydrogen decrepitation to not more than 1 mm.

15 g of the respective magnet alloys were placed in a treatment furnace and held in a low temperature hydrogen atmosphere at room temperature under 0.1 MPa for one hour (a low-temperature hydrogenation step). Subsequently, the magnet alloys were held in a high-temperature hydrogen atmosphere at 780 deg. C. under 0.03 MPa for 30 minutes (a high-temperature hydrogenation step). Then, the temperature of the atmosphere was increased to 840 deg. C. over 5 minutes and the magnet alloys were held in a high-temperature hydrogen atmosphere at 840 deg. C. under 0.03 MPa for 60 minutes (a structure stabilization step). While controlling reaction rate, forward transformation of decomposing the magnet alloys into three phases ($\alpha$-Fe, $RH_2$, $Fe_2B$) was thus caused (a disproportionation step) Subsequently, hydrogen was continuously exhausted from the treatment furnace and the magnet alloys were held in an atmosphere at 840 deg. C. under 5 to 1 kPa for 90 minutes, thereby causing reverse transformation of generating $R_2TM_4B_1$-type crystals in the magnet alloys after the forward transformation (a controlled exhaust step/a recombination step).

Subsequently, the magnet alloys were rapidly cooled (a first cooling step). A forced exhaust step was carried out by holding these magnet alloys in an atmosphere at 840 deg. C. under not more than $10^{-1}$ Pa for 30 minutes. After the thus obtained magnet alloys were pulverized in a mortar in an inert gas atmosphere, the particle diameter of the magnet alloys were controlled, thereby obtaining powdery magnet raw materials having a particle diameter of not more than 212 μm (average particle diameter: 100 μm). It should be noted that the average particle diameter of the magnet raw materials was measured by a laser diffraction particle size distribution measuring device Helos & Rodos, and the average particle diameter was evaluated by a volume-equivalent sphere diameter (VMD) (The same measurement method was employed in the following examples.) It should be noted that in this example the first cooling step was conducted before the forced exhaust step in consideration of mass production, but it is possible to carry out the forced exhaust step subsequently to the controlled exhaust step, and then cool the magnet alloys rapidly.

(2) Preparation of Diffusion Raw Materials

Various kinds of diffusion raw materials having the composition shown in Table 2 were prepared. These diffusion raw materials were produced as follows. First, raw materials were weighed so as to have the composition shown in Table 2 and melted, and raw material alloys cast by book molding process were obtained. After subjected to hydrogen decrepitation, the raw material alloys were further pulverized in a wet ball mill, thereby obtaining powdery diffusion raw materials (hydrides) having an average particle diameter of 6 μm. The raw material alloys after pulverization were dried in an inert gas atmosphere. Thus powdery diffusion raw materials were obtained.

(3) Mixing and Diffusion Treatment

The abovementioned various kinds of magnet raw materials and diffusion raw materials were mixed at the mixing ratios shown in Table 3A and Table 3B (hereinafter collectively referred to as "Table 3") in an inert gas atmosphere, thereby obtaining mixed raw materials (a mixing step). It should be noted that the mixing ratios are ratios by mass of the respective diffusion raw materials when the whole mixed raw materials are taken as 100% by mass.

These mixed raw materials were heated in a vacuum atmosphere under $10^{-1}$ Pa at 800 deg. C. for one hour (a diffusion step). Subsequently, the mixed raw materials were rapidly cooled (a second cooling step). Thus specimens comprising various kinds of anisotropic rare earth magnet powders (hereinafter simply referred to as "magnet powders") were obtained. Together shown in Table 3 is overall composition of the respective specimens (the composition of the respective magnet raw materials and the respective diffusion raw materials and the composition of the specimens after the diffusion treatment calculated from the mixing ratio of these raw materials). For comparison, various kinds of specimens without addition of diffusion raw materials or application of diffusion treatment (specimens just as the magnet raw materials) were also prepared and their composition is shown in Table 3 together.

<Measurement>

(1) Powder Particles

Crystal grain diameter of powder particles of the respective specimens was measured by using a SEM. All the crystals had grain diameters of not more than 1 μm and average crystal grain diameters of 0.2 to 0.5 μm. These average crystal grain diameters were measured in accordance with the method for measuring an average diameter d of crystal grains in JIS G0551. X-ray diffraction pattern observation confirmed that these powder particles had the same diffraction peaks as those of $Nd_2Fe_{14}B_1$.

(2) Magnetic Characteristics

The respective specimens (the magnet powders) were packed in capsules and oriented in a magnetic field of 1193 kA/m at a temperature of about 80 deg. C. and then magnetized at 3580 kA/m. Magnetic characteristics of the magnet powders after this magnetization were measured by using a VSM (Vibrating Sample Magnetometer). In this case, the respective specimens were assumed to have a density of 7.5 g/cm$^3$. The results thus obtained are shown in Table 3 together.

(3) Atomic Ratio of Cu

Regarding the respective specimens shown in Table 3, the ratio of Cu (at. %) to Nd (at. %) as a rare earth element (Rt) (Cu/Nd) was calculated from their overall composition and shown in Table 3 together. In addition, regarding specimen Nos. 1-1 to 1-10 (Nd—Cu) and specimen Nos. 2-1 to 2-5 (Nd—Cu—Al) shown in Table 3A, a relation between the atomic ratio of Cu and coercivity is shown in FIG. 1.

<Evaluation>

(1) Effects of Enveloping Layers or Diffusion Treatment

When attention is focused on specimen No. 5-5 in which the content of Nd as a rare earth element (Rm=Rt) in the magnet powder produced only with a magnet raw material (or simply a "magnet raw material") was close to a theoretical composition value of 11.8 at. % which is necessary to generate $R_2TM_{14}B_1$-type crystals, coercivity (iHc) was extremely low. Therefore, although having a composition which is supposed to inherently provide a high magnetic flux density (Br), specimen No. 5-5 was affected by the decrease in coercivity and, as a result, had a low magnetic flux density.

In contrast, when attention is focused on specimen Nos. 1-1 to 1-6 in which diffusion raw materials comprising, for example, NdCu were respectively diffused into the magnet raw material which had a similar composition to that of specimen No. 5-5 (M1 in Table 1), coercivity sharply increased. This tendency was similarly observed in specimen Nos. 2-1 to 2-4 in which diffusion raw materials comprising NdCuAl were respectively diffused. It is supposed to be because in these specimens which attained a sharp increase in coercivity, enveloping layers (a diffusion layer) comprising NdCu or NdCuAl were formed in grain boundaries of $Nd_2TM_{14}B_1$-type crystals by the diffusion treatment. On the other hand, in specimen Nos. 5-1 and 5-3 which contained Cu from the stage of base alloys (ingots) and were not subjected to diffusion treatment, coercivity was remarkably low. Especially when specimen No. 4-1 and specimen No. 5-1 or specimen No. 4-4 and specimen 5-3 are compared with each other, in spite of similar overall composition, specimen Nos. 5-1 and 5-3 containing Cu from the stage of ingots were degraded in magnetic characteristics and were remarkably decreased especially in coercivity than specimen Nos. 4-1 and 4-4 subjected to diffusion treatment.

These differences are supposed to be caused by a difference in the form of existence of Nd and Cu in the vicinity of $R_2TM_{14}B_1$-type crystals. That is to say, even if Nd and Cu are present in the vicinity of $R_2TM_{14}B_1$-type crystals in specimen Nos. 5-1 and 5-3 containing Cu from the stage of the ingots, the Nd and Cu are thought to be different in characteristics such as viscosity and wettability from the enveloping layers of the present invention and to have the shape of aggregates and not to envelop surfaces of crystals. In contrast, in specimen Nos. 4-1 and 4-4 subjected to the diffusion treatment, Nd and Cu had optimum composition for viscosity, wettability and so on, and the Nd and Cu are thought to have enveloped surfaces of $R_2TM_{14}B_1$-type crystals approximately uniformly or smoothly. As a result, it is estimated that in specimen Nos. 4-1 and 4-4, distortion present on the surfaces of the $R_2TM_{14}B_1$-type crystals was corrected or generation of reverse magnetic domains was effectively suppressed in the vicinity of the surfaces, and coercivity which was remarkably higher than those of specimen Nos. 5-1 and 5-3 was exhibited.

Moreover, a comparison between specimen Nos. 5-1 and 5-2 which contained Cu from the stage of ingots and had similar composition except the Cu content demonstrates that coercivity sharply decreases with an increase in the content of Cu. It is understood from this that even if Cu is contained from the stage of base alloys as in conventional methods, coercivity rather decreases and that Cu in such a case is not always an element to improve coercivity. Moreover, as apparent from a comparison between specimen Nos. 5-3 and 5-5, if Cu is merely present from the stage of base alloys, an improvement in coercivity cannot be expected and rather coercivity decreases even in a situation where an Nd-rich phase is formed. This is supposed to be because the enveloping layers of the present invention comprising NdCu or NdCuAl are not formed almost uniformly on surfaces of $R_2TM_{14}B_1$-type crystals. It should be noted that high coercivity of specimen No. 5-4 is attributed to the fact that magnet powder contained Ga, which improves coercivity.

(2) Cu Content and Nd Content

The overall composition and magnetic characteristics of the respective specimens shown in Table 3 and the graph of FIG. 1 show that there is a relation between coercivity of magnet powders and the Cu content and the Nd content in the magnet powders. That is to say, it is necessary for an improvement in coercivity of magnet powder to introduce not only Cu but also Nd (R') in an amount corresponding to that of Cu into crystal grain boundaries (or grain boundary phase) of $R_2TM_{14}B_1$-type crystals. For example, in specimen Nos. 1-1 to 1-6, Nd (R) was introduced in amounts exceeding a theoretical composition value of 11.8 at. % of R which is necessary to generate $R_2TM_{14}B_1$-type crystals by the diffusion treatment and Cu was also introduced in amounts corresponding to the amount of Nd. As a result, coercivity of these specimens was as high as more than 955 kA/m. On the other hand, when the Nd content was smaller when compared to the Cu content or only the Nd content was greater as in specimens Nos. 1-8 to 1-10, magnet powders having high coercivity could not be obtained.

This tendency is also seen in specimen Nos. 2-1 to 2-5 containing Al, which improves coercivity. For example, specimen No. 2-5 in which the Cu content and the Nd content were not balanced had a lower coercivity than other specimens. The same also applies to specimen Nos. 3-1 to 3-6. However, when the Nd content in the magnet raw material (M5) as a base material is excessively smaller than a theoretical composition value as in specimen No. 3-5, such a specimen cannot achieve an improvement in coercivity because soft magnetic αFe is contained in the magnet raw material and cannot be removed by diffusion treatment. In contrast, when a sufficient amount of Nd is present in a magnet raw material as in specimen Nos. 3-3, 3-4 and 3-6, such a specimen is supposed to attain a high coercivity because good enveloping layers comprising NdCu(Al) are easily formed on surfaces of $Nd_2TM_{14}B_1$-type crystals.

(3) Diffusion Raw Material

As apparent from specimen Nos. 4-1 to 4-7 shown in Table 3B, even when plural kinds of diffusion raw materials are used, a similar tendency to the abovementioned one is seen. Specimen No. 4-7 did not contain any rare earth element (R') in the diffusion raw material and the Nd content was close to a theoretical composition value of R which is necessary to generate $R_9TM_{14}B_1$-type crystals. This is supposed to have made it difficult to form enveloping layers containing Nd—Cu on surfaces of $Nd_2TM_{14}B_1$-type crystals and to have greatly decreased coercivity and magnetic flux density.

(4) TEM Observation of Powder Particles

Figure 2A:
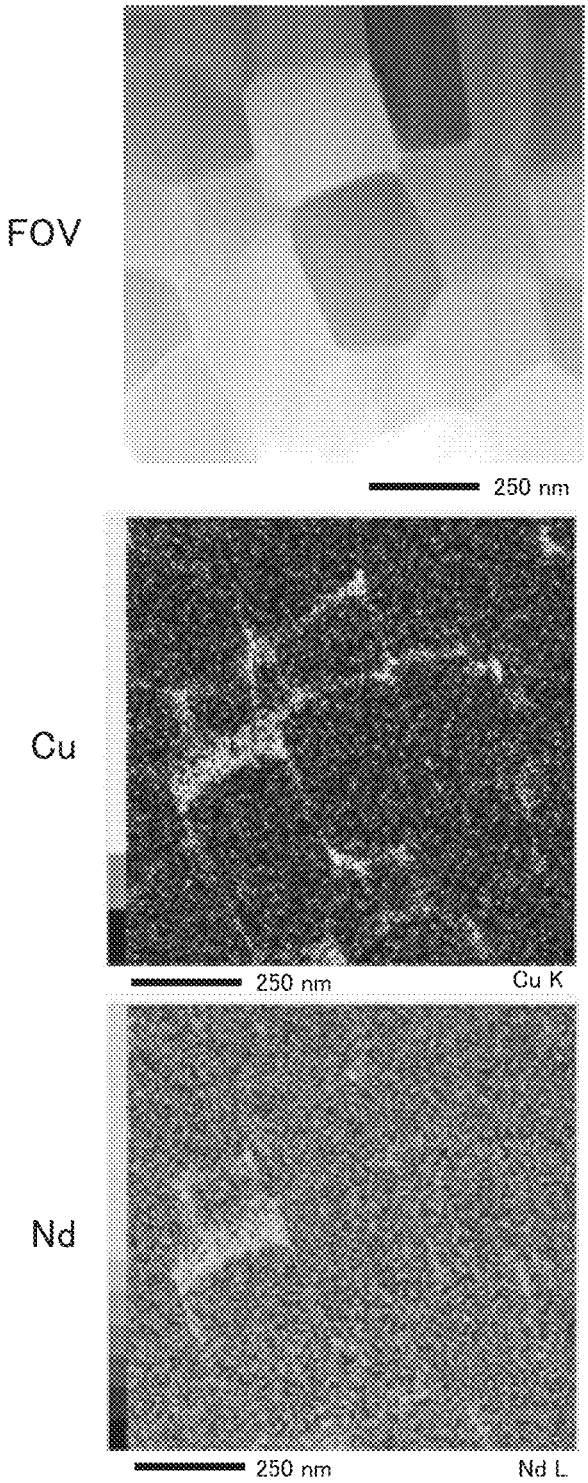
FIG. 2A shows TEM photographs of powder particles subjected to diffusion treatment.

Electron micrographs of powder particles of specimen No. 3-2 observed using a transmission electron microscope (TEM) are shown in FIG. 2A. TEM photographs of the powder particles before the diffusion treatment (magnet raw material M1) are shown in FIG. 2B.

Figure 2B:
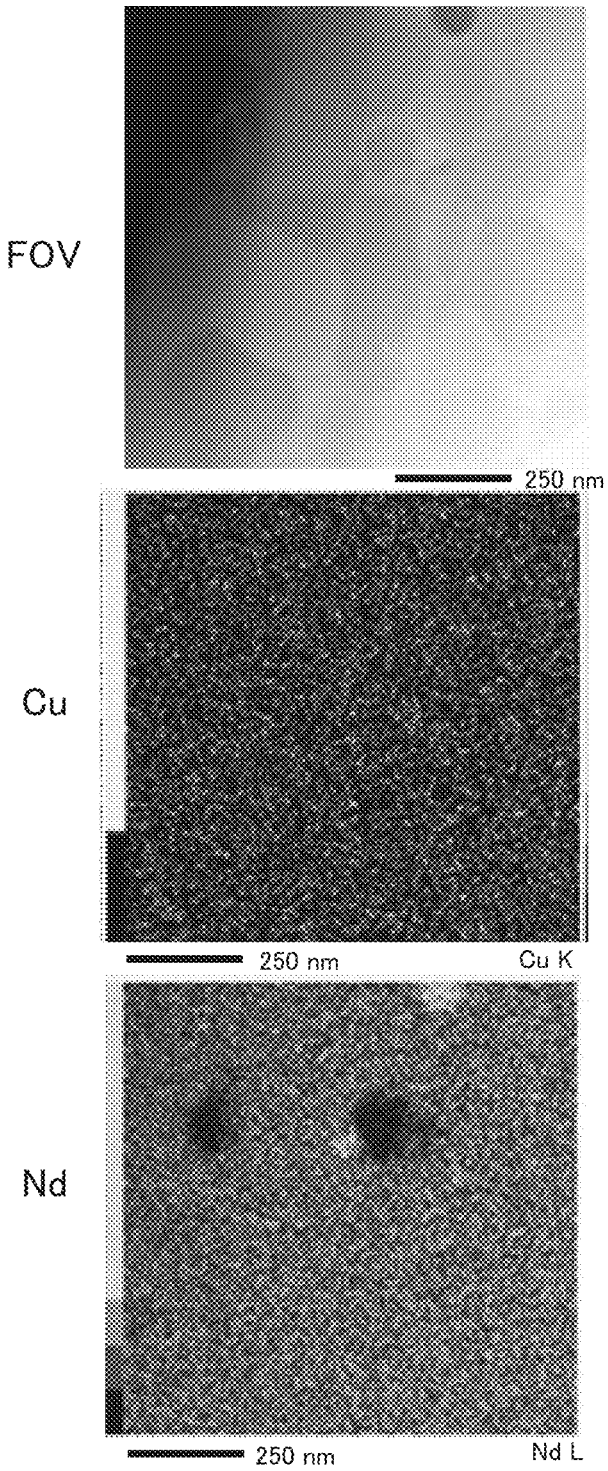
FIG. 2B shows TEM photographs of the powder particles before the diffusion treatment.
Figure 2C:
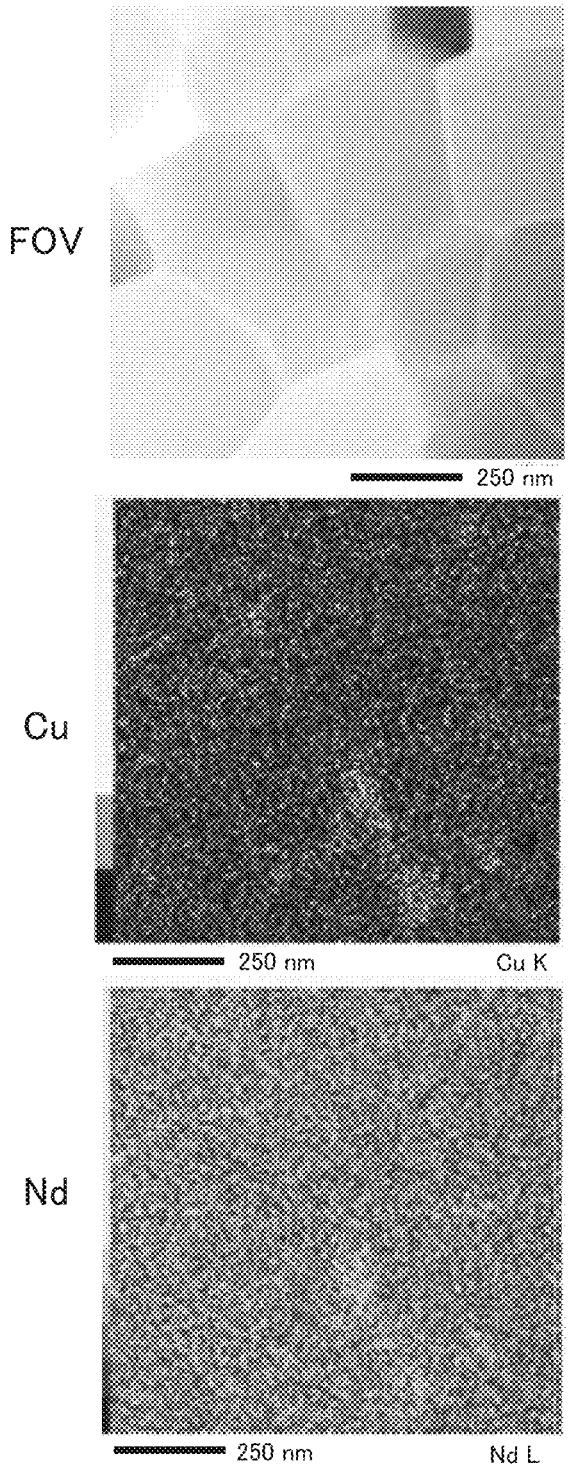
FIG. 2C shows TEM photographs of powder particles formed of a Cu-containing ingot and not subjected to diffusion treatment.

In addition, TEM photographs of powder particles obtained by applying the aforementioned hydrogenation treatment (d-HDDR) to a Cu and Al-containing ingot (Fe-12.9% Nd-6.4% B-0.1% Nb-0.1Cu-2.3% Al, unit: at. %) without diffusion treatment are shown in FIG. 2C.

First, as apparent from FIG. 2A, in the case of the powder particles subjected to the diffusion treatment, Cu-rich portions and Nd-rich portions which enveloped surfaces of $Nd_2TM_{14}B_1$-type crystals were clearly observed in crystal grain boundaries. It is apparent also from this that enveloping layers (a diffusion layer) comprising NdCu which enveloped crystal surfaces were formed.

On the other hand, in the case of powder particles before diffusion treatment, as apparent from FIG. 2B, not only Nd-rich portions but also Cu-rich portions were hardly observed. This is supposed to be because the Nd content in the magnet raw material (M1) was close to a theoretical composition and what is called an Nd-rich phase was hardly formed.

In the case of powder particles containing Cu and Al from the stage of an ingot, as apparent from FIG. 2C, Cu-rich portions and Nd-rich portions were slightly observed in crystal grain boundaries. However, these rich portions were only present at just small parts of some crystals and did not wholly envelop a surface of any of the crystals. It should be noted that magnetic characteristics of the specimen shown in FIG. 2C were coercivity (iHc): 1146 kA/m, residual magnetic flux density (Br): 1.32 (T), maximum energy product ((BH) max): 290 kJ/$m^3$, that is to say, the characteristics were lower in both coercivity and maximum energy product than those of specimen No. 3-2 shown in FIG. 2A. Such a difference in magnetic characteristics is supposed to be affected by formation of the abovementioned enveloping layers (the diffusion layer).

(5) SEM Observation of Powder Particles

Figure 3A:
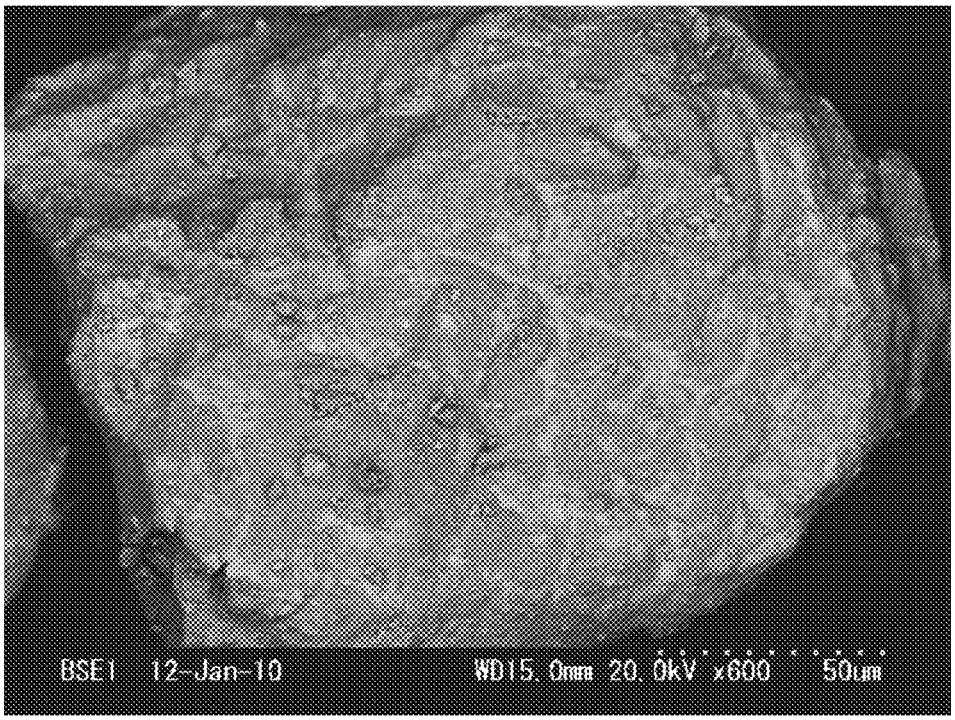
FIG. 3A shows a SEM photograph of powder particles subjected to diffusion treatment (diffusion raw material: 6% by mass).
Figure 3B:
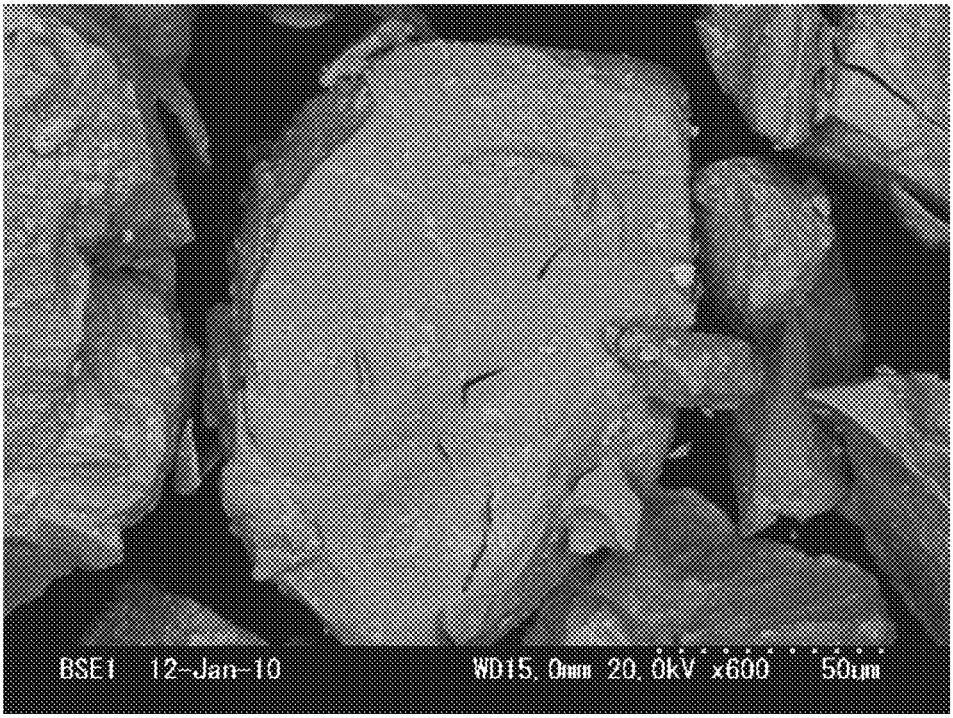
FIG. 3B shows a SEM photograph of powder particles subjected to diffusion treatment (diffusion raw material: 3% by mass).

An electron microphotograph of powder particles of specimen No. 3-2 (diffusion raw material C2: 6% by mass) observed by using a scanning electron microscope (SEM) is shown in FIG. 3A. In addition, a SEM photograph of another kind of powder particles in which the mixing ratio of the diffusion raw material C2 was changed to 3% by mass is shown in FIG. 3B. Furthermore, a SEM photograph of powder particles (specimen No. 5-4) before diffusion treatment is shown in FIG. 3C.

Figure 3C:
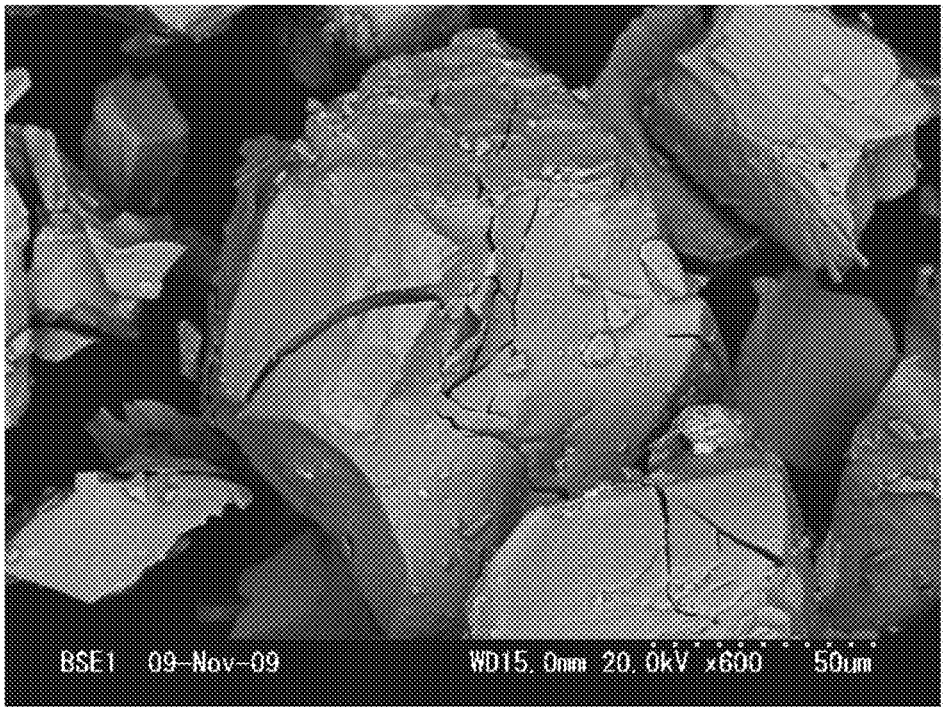
FIG. 3C shows a SEM photograph of powder particles before diffusion treatment.

First, as apparent from FIG. 3C, there were a number of cracks on surface portions of powder particles before diffusion treatment which were obtained by d-HDDR treatment. On the other hand, it is apparent from FIG. 3A and FIG. 3B that surfaces of the powder particles subjected to the diffusion treatment were continuous and those cracks disappeared. This is supposed to be because the diffusion raw material, which had a low melting point and good wettability, encapsulated surfaces of powder particles and at the same time filled the cracks which were generated after the d-HDDR treatment. This is also apparent from crack trace in thin lines seen on surfaces of the powder particles. It was also confirmed that when the mixing ratio of the diffusion raw material was about 3% by mass, cracks were hardly observed and when the mixing ratio of the diffusion raw material was about 6% by mass, cracks almost completely disappeared.

If cracks as starting points of split of powder particles thus decrease or disappear from surfaces of powder particles, naturally the powder particles become difficult to split and generation of newly-formed surfaces, which are easily oxidizable, is suppressed. As a result, a decrease in magnetic characteristics caused by oxidization is suppressed and bonded magnets comprising these powder particles exhibit a good permanent demagnetization ratio and consequently a good heat resistance. This was confirmed by actually producing bonded magnets as follows.

<Bonded Magnet>

(1) Production

Bonded magnets were produced by using the abovementioned three kinds of anisotropic rare earth magnet powders used in the SEM observation shown in FIG. 3A to FIG. 3C. Specifically, first prepared were compounds which comprised 3% by mass of solid epoxy resin, 15% by mass of commercially available anisotropic SmFeN-based magnet powder (produced by Sumitomo Metal Mining Co. Ltd. or Nitia Corporation) and the remainder being the respective magnet powders, based on the total mass of the respective compounds. These compounds were respectively obtained by adding the solid epoxy resin to the magnet powders which had been well mixed by a Henschel mixer and kneading the mixtures by a Banbury mixer while heated at 110 deg. C. It should be noted that all the abovementioned three kinds of magnet powders used herein had an average particle diameter of 100 μm. The anisotropic SmFeN-based magnet powder had a composition of Fe-10Sm-13% N (at. %) and an average particle diameter of 3 μm.

Next, the respective compounds were introduced into forming die cavities and warm formed at 150 deg. C. under 882 MPa in a magnetic field of 1200 kA/m, thereby obtaining compacts in a 7-mm square cube. These compacts were magnetized in a magnetic field of about 3600 kA/m (45 kOe), thereby obtaining bonded magnets as test specimens.

(2) Permanent Demagnetization Ratio

Permanent demagnetization ratio to serve as an index of heat resistance and weather resistance was calculated about each bonded magnet. A bonded magnet comprising the magnet powder of specimen No. 3-2 (the diffusion raw material: 6% by mass) had a permanent demagnetization ratio of 2.42% and an initial coercivity (coercivity before demagnetization) of 1312 kA/m. A bonded magnet comprising magnet powder containing 3% by mass of the diffusion raw material had a permanent demagnetization ratio of 3.81% and an initial coercivity of 1114 kA/m. On the other hand, a bonded magnet comprising the magnet powder of specimen No. 5-4, which was not subjected to diffusion treatment, had a permanent demagnetization ratio of 5.02% and an initial coercivity of 1058 kA/m.

It is apparent from these results that diffusion treatment and an increase in the mixing ratio of diffusion raw material improve a permanent demagnetization ratio. This agrees with the abovementioned SEM observations. That is to say, as the number of cracks on surfaces of powder particles was greater, the permanent demagnetization ratio deteriorated, and conversely, as the number of cracks decreased due to being filled with the diffusion raw material, the permanent demagnetization ratio improved. Besides, as the mixing ratio of the diffusion raw material was higher, coercivity of the bonded magnets in themselves increased. This is supposed to be because the diffusion raw material not only encapsulated surfaces of powder particles but also diffused into crystal grain boundaries so that enveloping layers which enveloped $Nd_2TM_{14}B_1$-type crystals were sufficiently formed.

It should be noted that the permanent demagnetization ratio is a ratio of permanent magnetic flux loss, which is irreversible even if the magnet is remagnetized, to initial magnetic flux, and, specifically speaking, was calculated as follows. First, initial magnetic flux $\varphi 0$ of a magnetized bonded magnet of a 7-mm square cube was measured. This bonded magnet was held in the air atmosphere at 120 deg. C. for 1000 hours. This bonded magnet was magnetized again under the same conditions as those of the first magnetization, and magnetic flux $\varphi 1$ at this time was measured again. Then a ratio of permanent magnetic flux loss ($\varphi 0-\varphi 1$) to the initial magnetic flux $\varphi 0$ ($(\varphi 0-\varphi 1)/\varphi 0$) was calculated. This was expressed in percent and used as a "permanent demagnetization ratio".

Example 2

The following respective specimens were produced in addition to the aforementioned specimens and evaluated in various points.

(1) Specimen No. 6-1

Specimen No. 6-1 shown in Table 4 comprised a magnet powder obtained by changing the temperature of the high-temperature hydrogenation step from 840 deg. C. to 860 deg. C. Overall composition, magnetic characteristics and so on of the thus obtained specimen are shown in Table 4. As apparent from Table 4, coercivity (iHc) of magnet powder can be further increased to about 1500 to 1650 kA/m by controlling the high-temperature hydrogenation step (the structure stabilization step) and applying the diffusion treatment. Production of the respective specimens was carried out under the same conditions as those of Example 1 (hereinafter referred to as the "standard conditions"), unless otherwise specified. The same applies to the following specimens.

(2) Specimen Nos. 7-1 to 7-13

Specimen Nos. 7-1 to 7-13 shown in Table 5 respectively comprised magnet powders produced by mixing diffusion raw materials in which Al contained in the diffusion raw material C2 was variously changed to other elements (X), at a ratio of 5% by mass based on the whole mixture (the total of the magnet raw material and the respective diffusion raw materials) and applying diffusion treatment. It should be noted that the diffusion raw material C2 had a composition of Nd80%-Cu10%-Al10% (% by mass). The respective specimens shown in Table 5 were produced by using diffusion raw materials in which 10% by mass of Al in the diffusion raw material C2 was replaced with 10% by mass of various elements (X) (Nd80%-Cu10%-X10%).

It is apparent from Table 5 that when a diffusion raw material containing Al in addition to Nd and Cu is used, coercivity (iHc) of magnet powder improves most. It is also apparent that the use of diffusion raw materials containing Ga, Co, Zr or the like are also effective in improving coercivity of magnet powders in the second place to those containing Al. It should be noted that since Ga, Co and so on are scarce like Dy, Tb, Ho and so on, it is preferable to suppress the use of these elements not only in a magnet raw material but also in a diffusion raw material.

(3) Specimen Nos. 8-1 to 8-4 and 9-1 to 9-4

Effects of the form of diffusion raw materials and the Cu content in diffusion raw materials on magnetic characteristics of magnet powders were examined by using respective specimens shown in Table 6. Specimen Nos. 8-1 to 8-4 were produced by using Nd—Cu alloy powders as diffusion raw materials, and specimen Nos. 9-1 to 9-4 were produced by using mixed powders of Nd powder and Cu powder as diffusion raw materials. It should be noted that the mixed powders of specimen Nos. 9-1 to 9-4 and Nd—Cu alloy powders of specimen Nos. 8-1 to 8-4 respectively corresponded to each other in terms of the Cu content.

Figure 4:
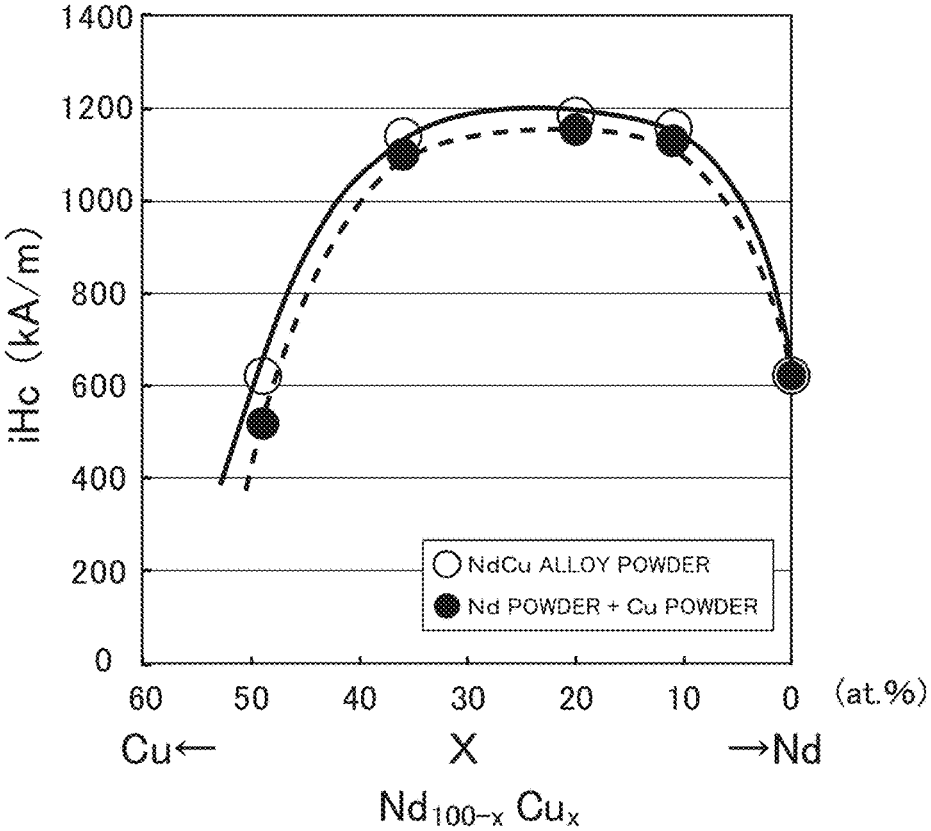
FIG. 4 is a graph showing a relation between the Cu content (the Nd content) in diffusion raw material and coercivity of magnet powder.

A relation between the Nd content in diffusion raw materials and coercivity (iHc) of the respective specimens is shown in Table 6 and FIG. 4 (Cu: X at. %). It is apparent from these that when diffusion raw materials have the same composition, respective specimens exhibit similar magnetic characteristics (especially coercivity). In other words, it can be said that a difference in supply form of diffusion raw materials gives little effect on magnetic characteristics of magnet powders. It is also apparent that in each case, if Cu is contained in an amount of 1 to 47 at. % or 6 to 39 at. % when the entire diffusion raw material is taken as 100 at. %, coercivity of magnet powder remarkably improves. This is supposed to be because the composition of such a diffusion raw material is close to eutectic composition and as a result, the melting point of the diffusion raw material decreases, and the diffusion raw material improves in wettability and easily encapsulates surfaces of powder particles and diffuses into crystal grain boundaries.

(4) Specimen Nos. 10-1 to 10-6

Based on the results shown in Table 6 and FIG. 4, respective specimens shown in Table 7 were further produced by using diffusion raw materials prepared from alloy powders having a composition of $(Nd_{0.8}Cu_{0.2})_{100-X}$—$Al_X$ (numerical values indicate atomic ratio). A relation between the Al content in diffusion raw materials and magnetic characteristics of obtained magnet powders of the respective specimens is shown in Table 7 and FIG. 5. It is apparent from these that if Al is contained in an amount of 2 to 62 at.

%, 6 to 60 at. % or 10 to 58 at. % when the entire diffusion raw material is taken as 100 at. %, coercivity of magnet powder remarkably improves.

(5) Specimen Nos. 11-1 to 11-2 and 12-1 to 12-2

Respective specimens shown in Table 8 were produced and examined about effect of a difference in production conditions of magnet raw materials before diffusion treatment on magnetic characteristics of magnet powders. "d-HDDR" in Table 8 indicates a method for producing a magnet raw material under the aforementioned standard conditions except that pressure in the treatment furnace was changed to 1 kPa in the controlled exhaust step.

Each of the magnet raw materials (base alloys) of the respective specimens shown in Table 8 had an approximate theoretical composition close to a theoretical composition (Nd: 11.8 at. %, B: 5.9 at. %). When the magnet raw materials had such a stoichiometric composition, all magnet powders before diffusion treatment had small coercivity (iHc).

However, when diffusion treatment was applied, coercivity of all the magnet powders greatly improved. It should be noted that when a magnet raw material contained Co, magnet powder had a higher Curie point and further improved in magnetic characteristics as a whole, but similarly showed the aforementioned tendency.

When magnet raw materials having approximate theoretical composition are thus used, d-HDDR is excellent in efficiently obtaining magnet powders having high magnetic characteristics. Hence, it is suitable that magnet raw materials used in the present invention are obtained through a low-temperature hydrogenation step of allowing a base alloy to absorb hydrogen in a low temperature range below temperatures at which disproportionation reaction occurs, before the disproportionation step.

(6) Specimen Nos. 13-1 to 13-4 and 14-1 to 14-4

Respective specimens shown in Table 9 were produced and examined about effect of a difference in composition of magnet raw materials on magnetic characteristics of magnet powders. It should be noted that magnet raw materials used in the respective specimens in Table 9 were produced under the aforementioned standard conditions (d-HDDR). However, specimen Nos. 13-1 and 13-2 were produced by controlling hydrogen pressure in the structure stabilization step to 0.02 MPa. Diffusion treatment applied to these magnet raw materials was carried out in the abovementioned way.

The following is apparent from magnetic characteristics of the respective specimens shown together in Table 9. When magnet raw materials having approximate theoretical composition were used, magnet powders before diffusion treatment exhibited high magnetization (Is) but extremely small coercivity (iHc) (specimen Nos. 13-1, 14-1). However, magnet powders obtained by applying diffusion treatment to these powders attained a sharp increase in coercivity while keeping their inherent high magnetization, and as a result, exhibited very high coercivity while having high residual magnetic flux density (specimen Nos. 13-2, 14-2).

On the other hand, when magnet raw materials in which the Rm (Nd) content and the B content are large and fall outside of an approximate theoretical composition range were used, despite of containing scarce Ga, which is a typical coercivity-improving element, magnet powders before diffusion treatment did not greatly improve in coercivity and did not have high magnetization (specimen Nos. 13-3, 14-3). Magnet powders obtained by applying diffusion treatment to these powders attained a sharp increase in coercivity but did not have high residual magnetic flux density (specimen Nos. 13-4, 14-4).

It is thus apparent that upon applying the diffusion treatment of the present invention to magnet raw materials having approximate theoretical composition, it becomes possible to obtain magnet powders as good as or better than conventional magnet powders in coercivity, residual magnetic flux density, maximum energy product and so on, without using a coercivity-improving element such as scarce Ga.

(7) Specimen Nos. 15-1 to 15-3 and 16-1 to 16-2

Various kinds of magnet powders containing Pr in addition to Nd as a rare earth element, and various kinds of magnet powders additionally containing a heavy rare earth element (Dy, Tb, Ho or the like) were produced and examined about magnetic characteristics. The results are shown in Table 10. Magnet raw materials used in the respective specimens in Table 10 were produced under the aforementioned standard conditions (d-HDDR). Herein, used as a supply source of Pr was an Nd and Pr-mixed rare earth raw material (didymium). Used as a supply source of a heavy rare earth element was a Dy alloy (58 at. % Dy-42 at. % Fe), which is a typical coercivity-improving element. Diffusion treatment was carried out in the aforementioned way.

The following is apparent from magnetic characteristics of the respective specimens together shown in Table 10. Specimen Nos. 15-1 to 15-3 in which at least one of magnet raw materials and diffusion raw materials contained Pr exhibited the same level of magnetic characteristics as specimen Nos. 3-2, 4-1 or the like, which had almost the same overall composition (the rare earth element was evaluated as Rt=Nd+Pr). It is apparent from these that, even if part of Nd in raw materials is replaced with Pr, magnet powders having good magnetic characteristics can be obtained just like the aforementioned respective specimens. Upon employing relatively inexpensive didymium as a rare earth element source, magnet powder having high magnetic characteristics can be obtained at low costs.

Both of specimen Nos. 16-1 and 16-2 in which a diffusion raw material contained a heavy rare earth element (Dy) greatly improved in coercivity over other specimens. Moreover, since both the specimens had almost the same overall composition (the rare earth element was evaluated as Rt=Nd+Pr), magnetic characteristics of these specimens were almost on the same level. It should be noted that residual magnetic flux density and maximum energy product of these specimens were somewhat lower than those of other specimens. This is because the amount of diffusion raw materials containing the heavy rare earth element was increased by 3% by mass.

(8) Specimen Nos. H1-1 to H2-2

In consideration of batch processing in mass production, various kinds of magnet powders shown in Table 11 which used magnet raw materials containing residual hydrogen (a hydride) were also produced. Specifically, the magnet powders were produced as follows. First prepared was 10 kg of a magnet alloy of Fe-12.2% Nd-6.5% B-0.2% Nb (at. %) obtained by SC process. This magnet alloy was subjected to hydrogen decrepitation in a hydrogen atmosphere under a hydrogen pressure of 0.10 MPa, thereby obtaining a powdery magnet raw material. After subjected to a low-temperature hydrogenation step, the magnet alloy was held in a high-temperature hydrogen atmosphere at 810 deg. C. under 0.03 MPa for 95 minutes (a high-temperature hydrogenation step). Then, the temperature of the atmosphere was increased to 860 deg. C. over 10 minutes and the magnet alloy was held in a high-temperature hydrogen atmosphere at 860 deg. C. under 0.03 MPa for 95 minutes (a structure stabilization step).

Then, while hydrogen was continuously exhausted from a treatment furnace, the magnet alloy was held in an atmosphere at 860 deg. C. under 5 to 1 kPa for 50 minutes (a controlled exhaust step). The magnet alloy after the controlled exhaust step was pulverized with a mortar in an inert gas atmosphere, thereby obtaining a magnet raw material powder having classified particle diameters of 45 to 212 μm (specimen No. H1-1), and a magnet raw material powder having classified particle diameters of 45 μm or less (specimen No. H2-1). These magnet raw material powders had a residual hydrogen concentration of 100 ppm (ratio by mass).

Also prepared was a magnet alloy which was subjected to a forced exhaust step (at 840 deg. C. for 10 minutes under not more than 50 Pa) subsequently to the controlled exhaust step. This magnet alloy was pulverized by a high-speed impact mill in an inert gas atmosphere, thereby obtaining a magnet raw material powder having classified particle diameters of 45 to 212 μm (specimen No. H1-2) and a magnet raw material powder having classified particle diameters of 45 μm or less (specimen No. H2-2). These magnet raw material powders had a residual hydrogen concentration of 15 ppm. These hydrogen concentrations were numerical values measured by a hydrogen analyzer (produced by Horiba, Ltd.). It should be noted that the respective magnet powders were produced under the standard conditions unless otherwise specified.

These respective specimens were put and sealed in separate plastic bags together with inert gas and stored for one month. The storage environment at that time was 35 to 40 deg. C. in temperature and 60 to 80% in relative humidity (RH). Then the aforementioned diffusion treatment was carried out using the respective magnet raw materials after storage. A hydride of Nd-14.5% Cu-34.2% Al (at. %) (C2 in Table 2) was used as a diffusion raw material.

Magnetic characteristics of the thus obtained respective magnet powders are shown together in Table 11. It should be noted that Hk shown in Table 11 is a magnetic field corresponding to 90% of residual magnetic flux density (Br) in the second quadrant of a magnetization curve (demagnetization curve) and serves as an index of squareness. As Hk is smaller, permanent demagnetization ratio (irreversible magnetic flux loss even if the temperature decreases) is greater and durability of permanent magnets used in a high-temperature environment decreases.

It is apparent from the results shown in Table 11 that, when a magnet raw material stored temporarily or for a long time is used, as the concentration of residual hydrogen is greater, magnet powder having high magnetic characteristics can be more stably obtained. In contrast, when the concentration of residual hydrogen is small, magnetic characteristics of magnet powder decrease and especially squareness (Hk), which affects temperature characteristics or high-temperature durability, greatly decreases. This tendency is more remarkable as magnet raw materials having smaller particle diameters (specimen Nos. H2-1 and H2-2), which are increased in surface area to be oxidized, are used.

Therefore, it is preferable that a magnet raw material to be mixed with a diffusion raw material contains hydrogen, which suppresses degradation by oxidation of the magnet raw material. In this case, the hydrogen concentration is preferably 40 to 1000 ppm or 70 to 500 ppm. When the hydrogen concentration is excessively low, a magnet raw material stored for a long time is easily oxidized or degraded, and starting points of reverse magnetic domains are easily generated in magnet powder. When the hydrogen concentration is excessively high, the controlled exhaust step cannot be completed and recombination of a magnet alloy decomposed into three phases can be incomplete, and instead magnetic characteristics of magnet powder may decrease.

It should be noted that when a magnet powder is produced by using a magnet raw material and a diffusion raw material comprising hydrides, hydrogen contained in these materials are removed during diffusion treatment in a high-temperature vacuum atmosphere. With the progression of dehydrogenation, the diffusion raw material having a low melting point starts melting and diffusing into the magnet raw material.

<Complementary Descriptions of the Present Invention>

(1) Relation Between the Rm (Nd) Content and Magnetic Characteristics

Figure 6A:
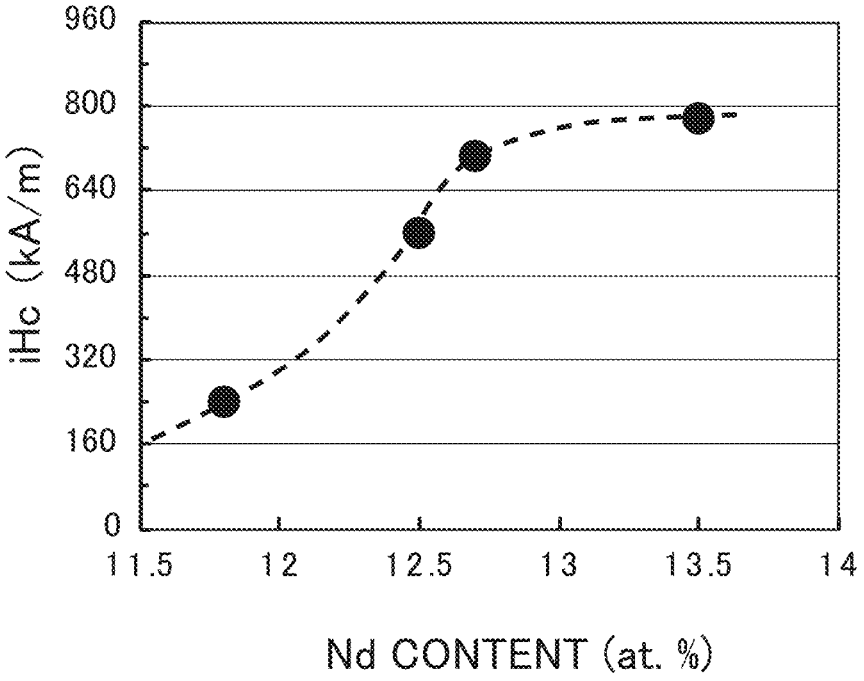
FIG. 6A is a dispersion diagram showing a relation between the Nd content and coercivity of magnet powder.
Figure 6B:
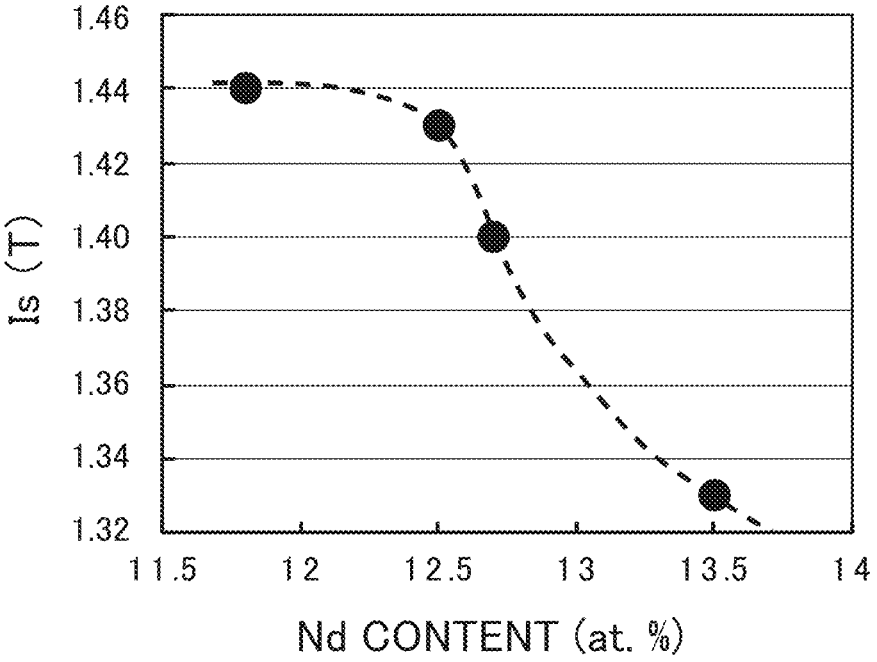
FIG. 6B is a dispersion diagram showing a relation between the Nd content and magnetization of magnet powder.

Magnet powders were produced under the standard conditions using various kinds of magnet alloys containing different amounts of Nd (Fe—X % Nd-(100-X) % B: at. %) and coercivity (iHc) of these powders is shown in FIG. 6A and saturation magnetization (Is) of these powders is shown in FIG. 6B. These figures demonstrate that magnetic characteristics of the magnet powders sharply change around 12.7 at. % of Rm (Nd). That is to say, it is apparent that magnet powders having approximate theoretical composition with not more than 12.7 at. % of Rm (Nd) inherently have high magnetization (and high residual magnetic flux density) but very small coercivity.

Herein, coercivity is generally thought to be exhibited by interrupting magnetic interaction between adjacent crystal grains and isolating crystal grains (single magnetic domain particles). It is conventionally usual as the isolating means to cause a non-magnetic Nd-rich phase to precipitate in grain boundaries. In this case, anisotropy and isolation are carried out simultaneously. In contrast, in the present invention, first, agglomerates of anisotropic single magnetic domain particles are produced by HDDR treatment (including d-HDDR treatment), and next, enveloping layers comprising a non-magnetic Nd-containing phase which isolates each of the single magnetic domain particles are formed around the single magnetic domain particles (crystal grains). This avoids a remarkable decrease in coercivity caused by magnetic interaction between adjacent single magnetic domain particles, and achieves an improvement in coercivity.

According to the present invention, while bringing the Nd content in the magnet raw material close to stoichiometric composition, the Nd content necessary for isolation can be decreased to a requisite minimum. As a result, the obtained magnet powder exhibits magnetization (Is) close to theoretical magnetization of $Nd_2TM_{14}B_1$-type crystals (saturation magnetization 1.6 T) and at the same time exhibits sufficiently high coercivity because an excessive precipitate such as the Nd-rich phase is excluded from grain boundaries and uniform Nd-containing non-magnetic enveloping layers are formed during diffusion treatment. Thus high saturation magnetization and high coercivity are attained at the same time.

Herein, it is assumed that effect of magnetic interaction of magnet raw material powder of the present invention and coercivity are inversely proportional. In the present invention, strength of the magnetic interaction is evaluated in terms of coercivity, and a state affected by magnetic interaction is determined to be not more than 720 kA/m. Closeness to theoretical magnetization in the present invention is indexed by Is, and saturation magnetization of magnet raw material powder of the present invention after hydrogen treatment is set to be not less than 1.4 T.

(2) Composition

Under these circumstances, upon applying diffusion treatment to a magnet raw material having approximate theoretical composition, the present invention has succeeded in obtaining magnet powder having high coercivity and high saturation magnetization or high residual magnetic flux density at the same time without decreasing high saturation magnetization which is to be inherently exhibited by the magnet raw material. This is apparent also from the results shown in Table 9.

Therefore, it is preferable that $Rm_2TM_{14}B_1$-type crystals and a magnet raw material have approximate theoretical composition. Specifically speaking, it is preferable that Rm is 11.6 to 12.7 at. %, 11.7 to 12.5 at. %, 11.8 to 12.4 at. % or 11.9 to 12.3 at. %, and B is 5.5 to 7 at. % or 5.9 to 6.5 at. %. Such a magnet raw material has magnetic characteristics exemplified by coercivity (iHc) of not more than 720 kA/m, not more than 600 kA/m, or not more than 480 kA/m, and magnetization (Is) of not less than 1.40 T, not less than 1.43 T or not less than 1.46 T.

Of course, small amounts of reforming elements (Nb, Zr, Ti, V, Cr, Mn, Ni, Mo, etc.) can be contained in such a magnet raw material. Preferably, the content of each of the reforming elements in the magnet raw material is, for example, not more than 2.2 at. %. Moreover, Co is a Group 8 element like Fe and an effective element in increasing a Curie point and the like. Therefore, 0.5 to 5.4 at. % of Co can be contained in the entire magnet powder. It should be noted that it is preferable to supply Co from at least one of the magnet raw material and the diffusion raw material.

In consideration of the above discussion, it is preferable that the anisotropic rare earth magnet powder of the present invention comprises 11.5 to 15 at. % (or 11.8 to 14.8 at. %) of Rt, 5.5 to 8 at. % (or 5.8 to 7 at. %) of B and 0.05 to 1 at. % of Cu. In this case, the remainder is principally TM but various kinds of reforming elements and inevitable impurities are permitted. If TM as the remainder is to be discussed, for example 76 to 83 at. % (or 77 to 82.7 at. %) of Fe and/or Co is preferred.

Further, it is preferable that the anisotropic rare earth magnet powder further contains 0.05 to 0.6 at. % of Nb and/or 0.1 to 2.8 at. % of Al. It should be noted that 0.05 to 0.8 at % (or 0.3 to 0.7 at. %) of Cu, 0.5 to 2 at. % of Al or 1 to 8 at. % (or 2 to 5 at. %) of Co are more preferred.

A certain amount of Cu is necessary to obtain magnet powder having magnetic characteristics as good as those of conventional anisotropic rare earth magnet powder using Dy, Ga and the like, which are scarce elements, while suppressing the use of these elements. For example, not less than 0.2 at. % of Cu is necessary to be contained when the whole powder particles after diffusion treatment are taken as 100 at. %, in order to obtain magnet powder having magnetic characteristics as good as those of specimen No. 5-4 (Br: 1.34 T, iHc: 1138 kA/m, BHmax: 326 kJ/$m^3$). However, if the Cu content exceeds 0.8%, an improvement in coercivity considerably slows down and at the same time residual magnetic flux density (Br) decreases.

Therefore, Cu is preferably contained in an amount of not more than 0.8 at. %, and more preferably in an amount of 0.3 to 0.7 at. %, as mentioned before, when the whole powder particles are taken as 100 at. %.

Moreover, it is suitable that a magnet raw material used in the method for producing the anisotropic rare earth magnet powder according to the present invention comprises 11.6 to 12.7 at. % of Rm, 5.5 to 7 at. % of B and the remainder being Fe and/or Co and inevitable impurities. It is preferable that the magnet raw material further contains 0.05 to 0.6 at. % of Nb. Furthermore, 1 to 8 at. % (or 1 to 5 at. %) of Co is more preferred.

In the meanwhile, it is suitable that a diffusion raw material used in the method for producing the anisotropic rare earth magnet powder according to the present invention comprises 1 to 47 at. % or 6 to 39 at. % of Cu, and the remainder being a rare earth element and inevitable impurities when the entire diffusion raw material is taken as 100 at. %, as mentioned before. When the diffusion raw material contains Al, it is suitable that the diffusion raw material comprises 5 to 27 at. % of Cu, 20 to 55 at. % of Al and the remainder being a rare earth element and inevitable impurities when the entire diffusion raw material is taken as 100 at. %.

Figure 5:
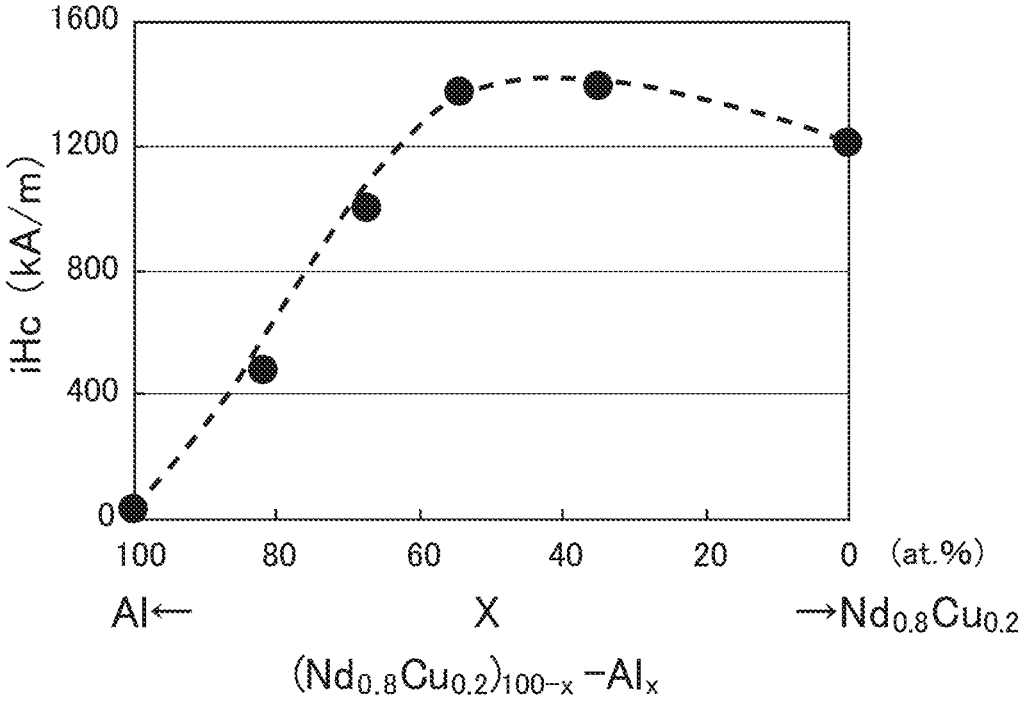
FIG. 5 is a dispersion diagram showing a relation between the Al content in diffusion raw material and coercivity of magnet powder.

Herein, as apparent from Table 6 and FIG. 4, when an Nd—Cu binary diffusion raw material is used, a preferred range of Cu (or a preferred atomic ratio of Nd to Cu) is relatively wide. Therefore, a preferred range of Al in Nd—Cu—Al ternary diffusion raw materials can vary in accordance with the atomic ratio of Nd to Cu. The ranges of Al shown in Table 7 and FIG. 5 are just examples. However, in consideration of the results shown in Table 6 and FIG. 4, it can be said that it is preferable that Cu and Al in Nd—Cu—Al ternary diffusion raw materials fall in the above ranges. It should be noted that the composition of the magnet raw material and the diffusion raw material shown here is composition before hydrogen treatment. It should be also noted that when the rare earth element (Rt, Rm, R' or the like) comprised two or more kinds of rare earth elements, the content shown is the total content of those elements.

(3) Rare Earth Element

The rare earth element (R, Rm, R') used in the magnet powder of the present invention is typically Nd but can include Pr. Even if part of Nd in the magnet raw material or the diffusion raw material is replaced with Pr, it gives little effect on magnetic characteristics. Besides, Nd and Pr-mixed rare earth raw materials (didymium) are available at relatively low costs. Therefore, it is preferable that the rare earth element of the present invention comprises a rare earth element mixture of Nd and Pr because costs of magnet powder can be reduced. Also, in order to further enhance coercivity of the anisotropic rare earth magnet powder of the present invention, at least one of Dy, Tb and Ho, which are typical coercivity-improving elements, can be contained in the main phase ($R_2TM_{14}B_1$-type crystals) or the enveloping layers. However, since these elements Dy, Tb, and Ho are scarce and expensive, it is preferable to suppress the use of these elements as much as possible.

Hence, it is preferable that the magnet raw material (R) and/or the diffusion raw material (R') of the present invention contain Pr together with Nd. In contrast, it is preferable that those raw materials do not contain Dy, Tb or Ho. Furthermore, the magnet raw material and/or the diffusion raw material can contain Y, La, and/or Ce in addition to Nd and Pr. When these rare earth elements are contained in small amounts, high magnetic characteristics of the anisotropic rare earth magnet powder of the present invention can be maintained. For example, not more than 3 at. % of each of these elements is permitted when the entire magnet raw material is taken as 100 at. %.

(4) Mixing Ratio of Diffusion Raw Material

Ratio of the diffusion raw material to be mixed with the magnet raw material can be arbitrarily controlled in accordance with composition of the magnet raw material, desired coercivity and the like. Even when a magnet raw material having approximate theoretical composition is used, magnet powder which exhibits not only high residual magnetic flux density (high magnetization) but also sufficiently high coercivity can be obtained by mixing the diffusion raw material in an amount of 1 to 10% by mass with respect to the entire mixed raw material.

However, there are some cases where high residual magnetic flux density is necessary but high coercivity is not necessary, depending on application purposes of magnet powders. In such a case, coercivity can be easily controlled by decreasing the mixing ratio of the diffusion raw material. For example, if a small amount of diffusion raw material is mixed to a magnet raw material having approximate theoretical composition and diffusion treatment is applied to the mixture, magnet powder having coercivity which is controlled in a desired range while keeping high magnetization can be easily obtained. Especially when the magnet raw material has approximate theoretical composition, even a small amount of diffusion raw material is thought to diffuse onto surfaces and into grain boundaries of crystals easily and uniformly. Examples of such a magnet powder are shown in Table 12. Magnet raw materials of the respective specimens were produced under the standard conditions. Specimen Nos. 17-2 and 18-2 were respectively obtained by mixing a relatively small amount, i.e., 1.5% by mass of the diffusion raw material C2 to these magnet raw materials and applying the aforementioned diffusion treatment to the mixtures.

TABLE 1

| MAGNET RAW | COMPOSITION OF MAGNET ALLOY (BASE ALLOY) (at. %) | | | |
|---|---|---|---|---|
| MATERIAL NO. | Nd | Nb | B | Fe |
| M1 | 12.1 | 0.2 | 6.5 | |
| M4 | 12.8 | 0.2 | 6.3 | |

TABLE 1-continued

| MAGNET RAW | COMPOSITION OF MAGNET ALLOY (BASE ALLOY) (at. %) | | | |
|---|---|---|---|---|
| MATERIAL NO. | Nd | Nb | B | Fe |
| M5 | 11 | 0.2 | 5.9 | bal. |
| M6 | 13.5 | 0.2 | 7 | |
| M7 | 12.1 | — | 6.4 | |

TABLE 2

| DIFFUSION RAW | COMPOSITION OF RAW MATERIAL ALLOY (at. %) | | | |
|---|---|---|---|---|
| MATERIAL NO. | Nd | Cu | Al | Ga |
| A1 | 79.9 | 20.1 | — | — |
| A2 | 63.8 | 36.2 | — | — |
| A3 | 50.7 | 49.3 | — | — |
| A4 | 26.5 | 73.5 | — | — |
| A5 | 9.9 | 90.1 | — | — |
| A6 | 100 | — | — | — |
| B1 | 56.7 | 7.6 | 35.7 | — |
| B2 | 48.1 | 9.1 | 42.7 | — |
| B3 | 35.1 | 11.4 | 53.6 | — |
| B4 | 18.9 | 14.6 | 66.6 | — |
| B5 | 5.5 | 16.8 | 77.7 | — |
| C1 | 79.9 | 20.1 | — | — |
| C2 | 51.3 | 14.5 | 34.2 | — |
| D1 | 65.9 | — | — | 34.1 |
| D2 | — | 17.3 | 82.7 | — |
| E1 | 42.8 | — | 57.2 | — |

TABLE 3A

| SPECIMEN NO. | MAGNET RAW MATERIAL | DIFFUSION RAW MATERIAL TYPE | DIFFUSION RAW MATERIAL MIXING RATIO (% by mass) | OVERALL COMPOSITION OF MAGNET POWDER (at. %) Nd | Nb | B | Cu | Al | Ga | Fe | ATOMIC RATIO OF Cu (Cu/Nd) (%) | MAGNETIC CHARACTERISTICS iHc (kA/m) | Br (T) | (BH)max (k J/m$^3$) |
|---|---|---|---|---|---|---|---|---|---|---|---|---|---|---|
| 1-1 | M1 | A1 | 3% | 13.2 | 0.2 | 6.3 | 0.3 | — | — | bal. | 2.3 | 1217 | 1.37 | 352 |
| 1-2 | | A2 | 3% | 13 | 0.2 | 6.3 | 0.6 | — | — | | 4.6 | 1106 | 1.39 | 352 |
| 1-3 | | A2 | 2% | 12.7 | 0.18 | 6.3 | 0.4 | — | — | | 3.1 | 1066 | 1.39 | 334 |
| 1-4 | | A1 | 2% | 12.8 | 0.18 | 6.3 | 0.2 | — | — | | 1.6 | 1090 | 1.38 | 331 |
| 1-5 | | A1 | 5% | 13.9 | 0.17 | 6.1 | 0.5 | — | — | | 3.6 | 1026 | 1.31 | 299 |
| 1-6 | | A1 | 7% | 14.6 | 0.17 | 6 | 0.7 | — | — | | 4.8 | 971 | 1.28 | 280 |
| 1-7 | | A3 | 3% | 12.8 | 0.19 | 6.3 | 0.9 | — | — | | 7.0 | 501 | 1.36 | 247 |
| 1-8 | | A4 | 3% | 12.5 | 0.2 | 6.2 | 1.7 | — | — | | 13.6 | 24 | 0.48 | 3 |
| 1-9 | | A5 | 3% | 12.1 | 0.19 | 6.2 | 2.4 | — | — | | 19.8 | 24 | 0.35 | 1 |
| 1-10 | | A6 | 3% | 13.3 | 0.2 | 6.3 | 0 | — | — | | 0.0 | 517 | 1.35 | 284 |
| 2-1 | M1 | B1 | 6% | 14 | 0.18 | 6.1 | 0.3 | 1.4 | — | bal. | 2.1 | 1400 | 1.37 | 326 |
| 2-2 | | B2 | 6% | 13.8 | 0.18 | 6 | 0.4 | 1.9 | — | | 2.9 | 1432 | 1.36 | 321 |
| 2-3 | | B3 | 6% | 13.4 | 0.18 | 6 | 0.6 | 2.8 | — | | 4.5 | 1352 | 1.34 | 314 |
| 2-4 | | B4 | 6% | 12.6 | 0.18 | 5.9 | 1 | 4.7 | — | | 7.9 | 1217 | 1.30 | 286 |
| 2-5 | | B5 | 6% | 11.5 | 0.17 | 5.8 | 1.5 | 7.3 | — | | 13.0 | 875 | 1.22 | 247 |
| 3-1 | M1 | C1 | 3% | 13.2 | 0.2 | 6.3 | 0.3 | — | — | bal. | 2.3 | 1217 | 1.39 | 352 |
| 3-2 | | C2 | 6% | 13.8 | 0.18 | 6.1 | 0.6 | 1.4 | — | | 4.3 | 1392 | 1.28 | 306 |
| 3-3 | M4 | C1 | 3% | 13.8 | 0.18 | 6.3 | 0.3 | — | — | | 2.2 | 1209 | 1.34 | 326 |
| 3-4 | | C2 | 6% | 14.4 | 0.18 | 6.1 | 0.6 | 1.4 | — | | 4.2 | 1416 | 1.22 | 288 |
| 3-5 | M5 | C1 | 3% | 12 | 0.18 | 5.8 | 0.3 | — | — | | 2.5 | 254 | 1.26 | 239 |
| 3-6 | M6 | C2 | 6% | 15.1 | 0.18 | 6.7 | 0.6 | 1.4 | — | | 4.0 | 1400 | 1.18 | 218 |

TABLE 3B

| SPECIMEN NO. | MAGNET RAW MATERIAL | DIFFUSION RAW MATERIAL TYPE | MIXING RATIO (% by mass) | OVERALL COMPOSITION OF MAGNET POWDER (at. %) Nd | Nb | B | Cu | Al | Ga | Fe | ATOMIC RATIO OF Cu (Cu/Nd) (%) | MAGNETIC CHARACTERISTICS iHc (kA/m) | Br (T) | (BH)max (k J/m$^3$) |
|---|---|---|---|---|---|---|---|---|---|---|---|---|---|---|
| 4-1 | M1 | A2, E1 | 3% of each | 13.8 | 0.2 | 6.2 | 0.6 | 1.4 | — | bal. | 4.3 | 1431 | 1.30 | 318 |
| 4-2 | M1 | A2, E1 D1 | 3% of each | 14.7 | 0.13 | 6.1 | 0.6 | 1.5 | 0.56 | | 4.1 | 1440 | 1.28 | 306 |
| 4-3 | M7 | A2, E1 | 3% of each | 13.8 | — | 6.2 | 0.6 | 1.4 | — | | 4.3 | 1352 | 1.25 | 294 |
| 4-4 | M1 | A2 | 3% | 13 | 0.19 | 6.3 | 0.6 | — | — | | 4.6 | 1106 | 1.42 | 358 |
| 4-5 | M1 | A2, D1 | 3% of each | 13.8 | 0.2 | 6.1 | 0.6 | — | 0.6 | | 4.3 | 1321 | 1.38 | 358 |
| 4-6 | M7 | A2 | 3% | 13 | — | 6.1 | 0.6 | — | — | | 4.6 | 1090 | 1.37 | 334 |
| 4-7 | M1 | D2 | 0.6% | 12 | 0.2 | 6.4 | 0.2 | 1.0 | — | | 2.5 | 24 | 0.37 | 2.4 |
| 5-1 | — | NO DIFFUSION TREATMENT | | 13.8 | 0.18 | 6.3 | 0.6 | 1.4 | — | | 4.3 | 159 | 1.24 | 199 |
| 5-2 | | | | 13.6 | 0.2 | 6.1 | 0.2 | 1.3 | — | | 1.5 | 939 | 1.30 | 247 |
| 5-3 | | | | 13.1 | 0.17 | 6.2 | 0.6 | — | — | | 4.6 | 40 | 1.13 | 159 |
| 5-4 | | | | 12.5 | 0.2 | 6.3 | — | — | 0.3 | | — | 1138 | 1.34 | 326 |
| 5-5 | | | | 12.1 | 0.2 | 6.1 | — | — | — | | — | 135 | 1.12 | 46 |

TABLE 4

| SPECIMEN NO. | MAGNET RAW MATERIAL | DIFFUSION RAW MATERIAL TYPE | MIXING RATIO (% by mass) | OVERALL COMPOSITION OF MAGNET POWDER (at. %) Nd | Nb | B | Cu | Al | Ga | Fe | ATOMIC RATIO OF Cu (Cu/Nd) (%) | MAGNETIC CHARACTERISTICS iHc (kA/m) | Br (T) | (BH)max (k J/m$^3$) |
|---|---|---|---|---|---|---|---|---|---|---|---|---|---|---|
| 6-1 | M1 | C2 | 6 | 13.8 | 0.18 | 6.1 | 0.6 | 1.4 | — | bal. | 4.3 | 1608 | 1.25 | 295 |

TABLE 5

| SPECIMEN NO. | MAGNET RAW MATERIAL | DIFFUSION RAW MATERIAL Nc180-Cu10-X10 (Composition: ratio by mass) MIXING RATIO OF DIFFUSION RAW MATERIAL TO THE WHOLE (% by mass) | X | MAGNETIC CHARACTERISTICS iHc (kA/m) | Br (T) | (BH)max (kJ/m$^3$) |
|---|---|---|---|---|---|---|
| 7-1 | M1 | 5 | Al | 1321 | 1.31 | 321 |
| 7-2 | | | Co | 1233 | 1.33 | 329 |
| 7-3 | | | Ni | 1194 | 1.37 | 323 |
| 7-4 | | | Si | 1194 | 1.33 | 332 |
| 7-5 | | | Mn | 1202 | 1.31 | 317 |
| 7-6 | | | Cr | 1218 | 1.33 | 330 |
| 7-7 | | | Mo | 1218 | 1.34 | 334 |

TABLE 5-continued

| SPECIMEN NO. | MAGNET RAW MATERIAL | DIFFUSION RAW MATERIAL Nc180-Cu10-X10 (Composition: ratio by mass) MIXING RATIO OF DIFFUSION RAW MATERIAL TO THE WHOLE (% by mass) | X | MAGNETIC CHARACTERISTICS iHc (kA/m) | Br (T) | (BH)max (kJ/m$^3$) |
|---|---|---|---|---|---|---|
| 7-8 | | | Ti | 1210 | 1.34 | 335 |
| 7-9 | | | V | 1226 | 1.32 | 321 |
| 7-10 | | | Ga | 1273 | 1.33 | 327 |
| 7-11 | | | Zr | 1233 | 1.34 | 327 |
| 7-12 | | | Ge | 1194 | 1.30 | 317 |
| 7-13 | | | Fe | 1194 | 1.32 | 324 |

TABLE 6

| SPECIMEN NO. | MAGNET RAW MATERIAL | DIFFUSION RAW MATERIAL TYPE | | RATIO OF Cu in DIFFUSION RAW MATERIAL (at. %) | MIXING RATIO OF DIFFUSION RAW MATERIAL TO THE WHOLE (% by mass) | MAGNETIC CHARACTERISTICS iHc (kA/m) | Br (T) | (BH)max (kJ/m$^3$) |
|---|---|---|---|---|---|---|---|---|
| 8-1 | M1 | Nd—Cu | A3 | 49.3 | 3 | 620 | 1.36 | 241 |
| 8-2 | | ALLOY | A2 | 36.2 | | 1138 | 1.37 | 343 |
| 8-3 | | POWDER | A1 | 20.1 | | 1186 | 1.38 | 352 |
| 8-4 | | | — | 10.7 | | 1154 | 1.38 | 351 |
| 8-5 | | | A6 | 0 | | 621 | 1.39 | 323 |
| 9-1 | M1 | Nd POWDER | | 49.3 | 3 | 517 | 1.37 | 294 |

TABLE 6-continued

| SPECIMEN NO. | MAGNET RAW MATERIAL | DIFFUSION RAW MATERIAL TYPE | RATIO OF Cu in DIFFUSION RAW MATERIAL (at. %) | MIXING RATIO OF DIFFUSION RAW MATERIAL TO THE WHOLE (% by mass) | MAGNETIC CHARACTERISTICS iHc (kA/m) | Br (T) | (BH)max (kJ/m$^3$) |
|---|---|---|---|---|---|---|---|
| 9-2 | | + | 36.2 | | 1098 | 1.36 | 337 |
| 9-3 | | Cu POWDER | 20.1 | | 1154 | 1.38 | 347 |
| 9-4 | | | 10.7 | | 1130 | 1.38 | 340 |
| 9-5 | | | 0 | | 621 | 1.39 | 323 |

TABLE 7

| SPECIMEN NO. | MAGNET RAW MATERIAL | MIXING RATIO OF DIFFUSION RAW MATERIAL TO THE WHOLE (% by mass) | DIFFUSION RAW MATERIAL $(Nd_{0.8}Cu_{0.2})_{100-x}$—$Al_x$ (Composition: Atomic Ratio) X (at. %) | MAGNETIC CHARACTERISTICS iHc (kA/m) | Br (T) | (BH)max (kJ/m$^3$) |
|---|---|---|---|---|---|---|
| 10-1 | M1 | 6 | 0 (Nd-20% Cu) | 1201 | 1.34 | 335 |
| 10-2 | | | 34.5 (Nd-13.2% Cu-34.5% Al) | 1384 | 1.30 | 314 |
| 10-3 | | | 54.2 (Nd-9.2% Cu-54.2% Al) | 1360 | 1.29 | 313 |
| 10-4 | | | 67 (Nd-6.6% Cu-67% Al) | 994 | 1.24 | 278 |
| 10-5 | | | 82.6 (Nd-3.5% Cu-82.6% Al) | 477 | 1.10 | 223 |
| 10-6 | | | 100 (Al100) | 23.8 | 1.00 | 159 |

TABLE 8

| SPECIMEN NO. | MAGNET RAW MATERIAL ALLOY COMPOSITION (at. %) | PRODUCTION METHOD | DIFFUSION RAW MATERIAL TYPE | MIXING RATIO OF DIFFUSION RAW MATERIAL TO THE WHOLE (% by mass) | MAGNETIC CHARACTERISTICS iHc (kA/m) | Br (T) | (BH)max (kJ/m$^3$) | Is (T) |
|---|---|---|---|---|---|---|---|---|
| 11-1 | Fe-12.0% Nd-6.5% B-0.2% Nb (≒ M-1) | d-HDDR | | — | 80 | 1.24 | 16 | 1.53 |
| 11-2 | | | C2 | 6 | 1393 | 1.29 | 302 | 1.40 |
| 12-1 | Fe-12.0% Nd-6.5% B-0.2% Nb-8% Co | d-HDDR | | — | 103 | 1.24 | 16 | 1.54 |
| 12-2 | | | C2 | 6 | 1432 | 1.30 | 310 | 1.41 |

TABLE 9

| SPECIMEN NO. | ALLOY COMPOSITION OF MAGNET RAW MATERIAL (at. %) | DIFFUSION RAW MATERIAL TYPE | MIXING RATIO OF DIFFUSION RAW MATERIAL TO THE WHOLE (% by mass) | MAGNETIC CHARACTERISTICS iHc (kA/m) | Br (T) | (BH)max (kJ/m$^3$) | Is (T) |
|---|---|---|---|---|---|---|---|
| 13-1 | Fe-11.9% Nd-5.9% B | | — | 167 | 0.96 | 44 | 1.44 |
| 13-2 | | C2 | 6 | 1393 | 1.10 | 212 | 1.33 |
| 13-3 | Fe-12.9% Nd-6.6% B- | | — | 875 | 1.21 | 260 | 1.37 |
| 13-4 | 0.1% Ga | C2 | 6 | 1353 | 1.03 | 183 | 1.27 |
| 14-1 | Fe-12.0% Nd-6.5% B-0.2% Nb | | — | 40 | 0.86 | 12 | 1.53 |
| 14-2 | (≒ M1) | C2 | 6 | 1385 | 1.29 | 309 | 1.42 |
| 14-3 | Fe-12.9% Nd-6.6% B-0.2% Nb- | | — | 971 | 1.33 | 302 | 1.44 |
| 14-4 | 0.1% Ga | C2 | 6 | 1353 | 1.22 | 255 | 1.34 |

TABLE 10

| SPECIMEN NO. | ALLOY COMPOSITION OF MAGNET RAW MATERIAL (at. %) | ALLOY COMPOSITION OF DIFFUSION RAW MATERIAL (at. %) + MIXING RATIO TO THE ENTIRE MIX POWDER | OVERALL COMPOSITION OF MAGNET POWDER (at. %) Nd | Pr | Dy | Nb | B | Cu | Al | Fe | ATOMIC RATIO OF Cu (Cu/Rt) (%) | MAGNETIC CHARACTERISTICS iHc (kA/m) | Br (T) | (BH)max (kJ/m$^3$) |
|---|---|---|---|---|---|---|---|---|---|---|---|---|---|---|
| 15-1 | Fe-9.7% Nd-2.5% Pr-5.9% B-0.2% Nb | Nd-14.5% Cu-34.2% Al (=C2) 6% by mass | 11.5 | 2.4 | — | 0.2 | 6.2 | 0.6 | 1.4 | bal. | 4.3 | 1432 | 1.31 | 327 |
| 15-2 | | Nd-10.5% Pr-14.5% Cu-34.1% Al 6% by mass | 11 | 2.8 | — | 0.2 | 6.2 | 0.6 | 1.4 | | 4.3 | 1392 | 1.29 | 318 |
| 15-3 | Fe-12.1% Nd-6.5% B-0.2% Nb (= M1) | | 13.4 | 0.4 | — | 0.2 | 6.2 | 0.6 | 1.4 | | 4.3 | 1400 | 1.30 | 313 |
| 16-1 | Fe-12.1% Nd-6.5% B-0.2% Nb (= M1) | Nd-14.5% Cu-34.2% Al: 6% by mass + | 13.6 | — | 1 | 0.2 | 6.1 | 0.6 | 1.4 | bal. | 4.4 | 1671 | 1.20 | 294 |
| 16-2 | Fe-9.7% Nd-2.5% Pr-5.9% B-0.2% Nb | Dy-42% Fe: 3% by mass | 11.3 | 2.3 | 1 | 0.2 | 6.1 | 0.6 | 1.4 | | 4.4 | 1751 | 1.19 | 290 |

Rt = R + R' = Nd + Pr

TABLE 11

| SPECIMEN NO. | MAGNET RAW MATERIAL PARTICLE DIAMETER (μ m) | HYDROGEN CONCENTRATION (PPM) | MAGNETIC CHARACTERISTICS iHc (kA/m) | Br (T) | (BH)max (kJ/m$^3$) | Hk (kA/m) |
|---|---|---|---|---|---|---|
| H1-1 | 45~212 | 100 | 1353 | 1.27 | 286 | 780 |
| H1-2 | | 15 | 1337 | 1.27 | 279 | 676 |

TABLE 11-continued

| SPECIMEN NO. | MAGNET RAW MATERIAL PARTICLE DIAMETER (μ m) | HYDROGEN CONCENTRATION (PPM) | MAGNETIC CHARACTERISTICS iHc (kA/m) | Br (T) | (BH)max (kJ/m$^3$) | Hk (kA/m) |
|---|---|---|---|---|---|---|
| H2-1 | 45 or less | 100 | 1313 | 1.24 | 271 | 700 |
| H2-2 | | 15 | 1305 | 1.23 | 239 | 557 |

MAGNET RAW MATERIAL: Fe-12.2% Nd-6.5% B-0.2% Nb (at. %)
DIFFUSION RAW MATERIAL: C2/Nd-14.5% Cu-34.2% Al (at. %)
MIXING RATIO OF DIFFUSION RAW MATERIAL TO THE ENTIRE MIXED POWDER: 6% by mass

TABLE 12

| SPECIMEN NO. | ALLOY COMPOSITION OF MAGNET RAW MATERIAL (at. %) | DIFFUSION RAW MATERIAL TYPE | MIXING RATIO OF DIFFUSION RAW MATERIAL TO THE WHOLE (% by mass) | MAGNETIC CHARACTERISTICS iHc (kA/m) | Br (T) | (BH)max (kj/m$^3$) | Hk (kA/m) |
|---|---|---|---|---|---|---|---|
| 17-1 | Fe-12.0% Nd-6.5% B- | | — | 40 | 0.86 | 12 | 1.53 |
| 17-2 | 0.2% Nb (≒ M1) | C2 | 1.5 | 871 | 1.39 | 344 | 1.48 |
| 18-1 | Fe-12.0% Nd-6.5% B- | | — | 160 | 1.21 | 200 | 1.50 |
| 18-2 | 0.2% Nb-3.0% Co | C2 | 1.5 | 994 | 1.38 | 338 | 1.47 |

What is claimed is:

1. An anisotropic rare earth magnet powder including powder particles comprising:

agglomerates of crystals of a tetragonal compound having a form $R_2TM_{14}B_1$ consisting of one or more rare earth elements (hereinafter referred to as "R"), boron (hereinafter referred to as "B"), and one or more transition elements (hereinafter referred to as "TM"), the crystals having an average crystal grain diameter of 0.05 to 1 μm, and enveloping layers containing at least neodymium (Nd) and copper (Cu), wherein surfaces of the crystals are enveloped by the enveloping layers, when the whole powder particles are taken as 100 atomic % (at. %), the powder particles contain:

11.5 to 15 atomic % of total rare earth element (Rt);

5.5 to 8 atomic % of B; and about 0.05 atomic % to about 2 atomic % of Cu, wherein, the powder particles have an atomic ratio of Cu, which is a ratio of the total number of Cu atoms to a total number of atoms of Rt, falling within the range of 1 to 6%;

the powder particles do not include dysprosium (Dy), terbium (Tb), holmium (Ho) and gallium (Ga), and coercivity (iHc) of the magnetic powder is more than 955 kA/m and less than or equal to 1608 kA/m.

2. The anisotropic rare earth magnet powder according to claim 1, wherein, when the whole powder particles are taken as 100 atomic %, the powder particles contain a total of no more than 3 atomic % of one or more of the group consisting of Ti, V, Zr, Nb, Ni, Cr, Mn, Mo, Hf, W, Ta, Si, Zn and Sn.

3. The anisotropic rare earth magnet powder according to claim 1, wherein, when the whole powder particles are taken as 100 atomic %, the powder particles contain 0.1 to 10 atomic % of Co.

4. The anisotropic rare earth magnet powder according to claim 1, wherein, the enveloping layers comprise a diffusion layer in which are diffused into crystal grain boundaries of the type crystals.

5. A method for producing the anisotropic rare earth magnet powder according to claim 1 comprising:

a mixing step of obtaining a mixed raw material of a magnet raw material capable of generating agglomerates of crystals of the tetragonal compound having the form $R_2TM_{14}B_1$ of R, B and TM, and a diffusion raw material to serve as a supply source of at least Nd and Cu; and a diffusion step of heating the mixed raw material to diffuse at least Nd and Cu onto surfaces or into crystal grain boundaries of the crystals; wherein when the whole magnet raw material is taken as 100 atomic %, the magnet raw material contains an approximate theoretical composition consisting essentially of:

11.6 to 12.7 atomic % of R;

5.5 to 7 atomic % of B; and remaining atomic % of TM.

6. The method for producing the anisotropic rare earth magnet powder according to claim 5, wherein the magnet raw material is obtained through:

a disproportionation step of causing a base alloy to absorb hydrogen and undergo a disproportionation reaction; and a recombination step of dehydrogenating and recombining the base alloy after the disproportionation step.

7. The method for producing the anisotropic rare earth magnet powder according to claim 6, wherein the magnet raw material is obtained further through, before the disproportionation step, a low-temperature hydrogenation step at a temperature of 600° C. or lower to allow the base alloy to absorb hydrogen in a temperature range below temperatures at which the disproportionation reaction occurs.

8. A bonded magnet, comprising:

the anisotropic rare earth magnet powder according to claim 1; and a resin bonding the powder particles together.

9. An anisotropic rare earth magnet powder including powder particles comprising:

agglomerates of crystals of a tetragonal compound having a form $R_2TM_{14}B_1$ consisting of one or more rare earth elements (hereinafter referred to as "R"), boron (hereinafter referred to as "B"), and one or more transition elements (hereinafter referred to as "TM"), the crystals having an average crystal grain diameter of 0.05 to 1 μm, and enveloping layers containing at least neodymium (Nd), copper (Cu) and aluminum (Al), wherein surfaces of the crystals are enveloped by the enveloping layers, when the whole powder particles are taken as 100 atomic % (at. %), the powder particles contain:

11.5 to 15 atomic % of total rare earth element(Rt);

5.5 to 8 atomic % of B;

about 0.05 atomic % to about 2 atomic % of Cu; and 0.1 to 5 atomic % of Al, wherein, the powder particles have an atomic ratio of Cu, which is a ratio of the total number of Cu atoms to a total number of atoms of Rt, falling within the range of 0.6 to 11.8%;

the powder particles do not include dysprosium (Dy), terbium (Tb), holmium (Ho) and gallium (Ga), and coercivity (iHc) of the magnetic powder is more than 955 kA/m and less than or equal to 1608 kA/m.

10. The anisotropic rare earth magnet powder according to claim 9, wherein, when the whole powder particles are taken as 100 atomic %, the powder particles contain a total of no more than 3 atomic % of one or more of the group consisting of Ti, V, Zr, Nb, Ni, Cr, Mn, Mo, Hf, W, Ta, Si, Zn and Sn.

11. The anisotropic rare earth magnet powder according to claim 9, wherein, when the whole powder particles are taken as 100 atomic %, the powder particles contain 0.1 to 10 atomic % of Co.

12. The anisotropic rare earth magnet powder according to claim 9, wherein, the enveloping layers comprise a diffusion layer in which are diffused into crystal grain boundaries of the crystals.

13. A method for producing the anisotropic rare earth magnet powder according to claim 9 comprising:

a mixing step of obtaining a mixed raw material of a magnet raw material capable of generating agglomerates of the crystals of the tetragonal compound having the form $R_2TM_{14}B_1$ of R, B and TM, and a diffusion raw material to serve as a supply source of at least Nd and Cu; and a diffusion step of heating the mixed raw material to diffuse at least Nd and Cu onto surfaces or into crystal grain boundaries of the crystals; wherein when the whole magnet raw material is taken as 100 atomic %, the magnet raw material contains an approximate theoretical composition consisting essentially of:

11.6 to 12.7 atomic % of R;

5.5 to 7 atomic % of B; and remaining atomic % of TM.

14. The method for producing the anisotropic rare earth magnet powder according to claim 13, wherein the magnet raw material is obtained through:

a disproportionation step of causing a base alloy to absorb hydrogen and undergo a disproportionation reaction; and a recombination step of dehydrogenating and recombining the base alloy after the disproportionation step.

15. The method for producing the anisotropic rare earth magnet powder according to claim 14, wherein the magnet raw material is obtained further through, before the disproportionation step, a low-temperature hydrogenation step at a temperature of 600° C. or lower to allow the base alloy to absorb hydrogen in temperature range below temperatures at which the disproportionation reaction occurs.

16. A bonded magnet, comprising:

the anisotropic rare earth magnet powder according to claim 9; and a resin bonding the powder particles together.

* * * * *